US009519250B2

(12) United States Patent
Asaka et al.

(10) Patent No.: US 9,519,250 B2
(45) Date of Patent: Dec. 13, 2016

(54) HEATER AND IMAGE HEATING APPARATUS, THE HEATER HAVING HEAT GENERATING PORTIONS DISPOSED OFFSET FROM A CENTER LINE OF A SUBSTRATE

(71) Applicant: CANON KABUSHIKI KAISHA, Tokyo (JP)

(72) Inventors: Akeshi Asaka, Kashiwa (JP); Toshinori Nakayama, Kashiwa (JP); Shigeaki Takada, Abiko (JP); Masayuki Tamaki, Abiko (JP); Naoki Akiyama, Toride (JP); Koichi Kakubari, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/993,488

(22) Filed: Jan. 12, 2016

(65) Prior Publication Data

US 2016/0202649 A1 Jul. 14, 2016

(30) Foreign Application Priority Data

Jan. 14, 2015 (JP) ..... 2015-004729
Nov. 9, 2015 (JP) ..... 2015-219840

(51) Int. Cl.
*G03G 15/20* (2006.01)
*G03G 15/00* (2006.01)

(52) U.S. Cl.
CPC ..... *G03G 15/2053* (2013.01); *G03G 15/80* (2013.01)

(58) Field of Classification Search
CPC ..... G03G 15/2053; G03G 15/80
USPC ..... 399/329, 334; 219/216, 539, 541
See application file for complete search history.

(56) References Cited

U.S. PATENT DOCUMENTS

| | | | |
|---|---|---|---|
| 7,200,354 | B2 | 4/2007 | Nakamoto et al. |
| 7,260,351 | B2 | 8/2007 | Nakayama |
| 7,263,303 | B2 | 8/2007 | Nakayama |
| 7,343,130 | B2 | 3/2008 | Nakayama |
| 7,430,392 | B2 | 9/2008 | Ito et al. |
| 7,457,576 | B2 | 11/2008 | Takada et al. |
| 7,460,821 | B2 | 12/2008 | Ai et al. |
| 7,466,950 | B2 | 12/2008 | Matsuura et al. |
| 7,505,724 | B2 | 3/2009 | Nakayama |
| 7,590,366 | B2 | 9/2009 | Nakayama |
| 7,596,348 | B2 | 9/2009 | Nakamoto et al. |
| 7,729,628 | B2 | 6/2010 | Nakayama |
| 7,844,208 | B2 | 11/2010 | Hayashi et al. |

(Continued)

FOREIGN PATENT DOCUMENTS

JP 2012-37613 A 2/2012

OTHER PUBLICATIONS

U.S. Appl. No. 14/857,086, filed Sep. 17, 2015.

(Continued)

*Primary Examiner* — William J Royer
(74) *Attorney, Agent, or Firm* — Fitzpatrick, Cella, Harper & Scinto

(57) ABSTRACT

A heater includes a substrate, a first electrical contact, second electrical contacts, first electrode portions and second electrode portions, heat generating portions, a first electroconductive line portion, and a second electroconductive line portion. The heat generating portions are disposed so as to be offset from a center line of the substrate with respect to a widthwise direction of the substrate.

5 Claims, 10 Drawing Sheets

(56) References Cited

U.S. PATENT DOCUMENTS

| | | | | |
|---|---|---|---|---|
| 7,907,861 | B2 | 3/2011 | Nakayama | |
| 8,145,086 | B2 | 3/2012 | Chiyoda et al. | |
| 8,301,067 | B2 | 10/2012 | Takada | |
| 8,306,446 | B2 | 11/2012 | Ito et al. | |
| 8,559,837 | B2 | 10/2013 | Nakayama | |
| 8,592,726 | B2 * | 11/2013 | Tsuruya et al. | G03G 15/2042 399/329 |
| 8,642,927 | B2 * | 2/2014 | Shimura | G03G 15/2082 219/216 |
| 8,698,046 | B2 * | 4/2014 | Shimura et al. | H05B 3/0095 399/329 |
| 8,712,271 | B2 | 4/2014 | Nakayama et al. | |
| 8,750,739 | B2 | 6/2014 | Tamaki et al. | |
| 8,818,222 | B2 | 8/2014 | Tamaki | |
| 8,867,941 | B2 | 10/2014 | Takada | |
| 8,913,936 | B2 | 12/2014 | Takada et al. | |
| 8,917,999 | B2 | 12/2014 | Takada et al. | |
| 8,918,003 | B2 | 12/2014 | Kawai et al. | |
| 8,929,762 | B2 | 1/2015 | Shinagawa et al. | |
| 8,989,640 | B2 | 3/2015 | Kitagawa et al. | |
| 2011/0082260 | A1 | 4/2011 | Omata et al. | |
| 2012/0224876 | A1 | 9/2012 | Nakayama et al. | |
| 2013/0142532 | A1 | 6/2013 | Kitagawa et al. | |
| 2013/0206745 | A1 | 8/2013 | Tanaka et al. | |
| 2013/0299480 | A1 | 11/2013 | Kakubari et al. | |
| 2013/0322897 | A1 | 12/2013 | Yago et al. | |
| 2014/0105658 | A1 | 4/2014 | Tamaki | |
| 2014/0112692 | A1 | 4/2014 | Omata et al. | |
| 2015/0212473 | A1 | 7/2015 | Kitagawa et al. | |
| 2015/0338805 | A1 | 11/2015 | Nakayama | |
| 2015/0338806 | A1 | 11/2015 | Nakayama | |
| 2015/0341985 | A1 | 11/2015 | Nakayama | |
| 2015/0341986 | A1 | 11/2015 | Nakayama | |

OTHER PUBLICATIONS

U.S. Appl. No. 14/844,249, filed Sep. 3, 2015.
U.S. Appl. No. 14/799,056, filed Jul. 14, 2015.
U.S. Appl. No. 14/799,123, filed Jul. 14, 2015.
U.S. Appl. No. 14/794,869, filed Jul. 9, 2015.

* cited by examiner

PRIOR ART

PRIOR ART

HEATER AND IMAGE HEATING APPARATUS, THE HEATER HAVING HEAT GENERATING PORTIONS DISPOSED OFFSET FROM A CENTER LINE OF A SUBSTRATE

FIELD OF THE INVENTION AND RELATED ART

The present invention relates to a heater and an image heating apparatus provided with the heater. The image heating apparatus is usable with an image forming apparatus such as a copying machine, a printer, a facsimile machine, a multifunction machine having a plurality of functions thereof or the like.

An image forming apparatus is known in which a toner image is formed on the sheet and is fixed on the sheet by heat and pressure in a fixing device (image heating apparatus). As for such a fixing device, a type of fixing device is proposed (Japanese Laid-open Patent Application 2012-37613) in which a heat generating element (heater) is contacted to an inner surface of a thin flexible belt to apply heat to the belt. Such a fixing device is advantageous in that the structure has a low thermal capacity, and therefore, a rising process can be performed in a short time.

Japanese Laid-open Patent Application (JP-A) 2012-37613 discloses that a heat generating region width of the heater is controlled in accordance with a width size of the sheet. FIG. 10 is a circuit diagram of the fixing device disclosed in JP-A 2012-37613. In this fixing device, as shown in FIG. 10, electrodes 1027 (1027*a*-1027*f*) are arranged in a longitudinal direction of a substrate 1021, and electric energy is supplied from the electrodes 1027 to heat generating resistance layers 1025 (1025*a*-1025*e*), so that the heat generating resistance layers 1025 are caused to generate heat.

In this fixing device, the electrodes 1027 are connected with electroconductive line layers 1029 (1029*a*, 1029*b*). Each of the electroconductive line layers 1029 extends toward an end portion of the substrate 1021 with respect to a longitudinal direction of the substrate 1021, and is connected with a power (voltage) supply circuit by an electroconductive line member. Specifically, the electroconductive line layer 1029*d* connected with the plurality of electrodes 1027, the electroconductive line layer connected with the electrode 1027*b*, and the electroconductive line layer connected with the electrode 1027*d* extend toward one longitudinal end of the substrate 1021. The plurality of electrodes 1027 connected with the electroconductive line layer are the electrodes 1027 1027*a*, 1027*c*, 1027*e*. The electroconductive line layer 1029*c* connected with the plurality of electrodes 1027, the electroconductive line layer 1029*i* connected with the electrode, and the electroconductive line layer connected with the electrode extend toward the other longitudinal end of the substrate 1021. The plurality of electrodes 1027 connected with the electroconductive line layer are the electrodes 1027.

At the one longitudinal end of the substrate 1021, each of the electrode 1027*a* and the electroconductive line layers is connected with the electroconductive line member 1029. At the other longitudinal end of the substrate, each of the electrode 1027*t* and the electroconductive line layers is connected with the electroconductive line member 1029. Thus, a heat generating element 1006 is electrically connected with the power supply circuit.

The power supply circuit includes an AC power (voltage) source and switches 1033 (1033*a*, 1033*b*, 1033*c*, 1033*d*), and a connecting pattern of each electroconductive line layer 1029 is changed by a combination of turning-on and turning-off of the switch 1033. That is, each of the electroconductive line layers 1029 is connected with either one of a power source terminal 1031*a* and a power source terminal 1031*b* depending on the connecting pattern in the power supply circuit. By employing such a constitution, a width of a heat generating region of the heat generating resistance layer 1025 is changed depending on a width size of the sheet.

According to study by the present inventors, it was found that there is room for improvement.

SUMMARY OF THE INVENTION

According to an aspect of the present invention, there is provided a heater usable with an image heating apparatus including an electric energy supplying portion provided with a first terminal and a second terminal, and an endless belt configured to heat an image on a sheet, wherein the heater is contactable to the belt to heat the belt, said heater comprising: a substrate; a first electrical contact provided on the substrate and electrically connectable with the first terminal; a plurality of second electrical contacts provided on the substrate and electrically connectable with the second terminal; a plurality of electrode portions including first electrode portions electrically connected with the first electrical contact and second electrode portions electrically connected with the second electrical contacts, the first electrode portions and the second electrode portions being arranged alternately with predetermined gaps in a longitudinal direction of the substrate; a plurality of heat generating portions provided between adjacent ones of the electrode portions so as to electrically connect between adjacent electrode portions, the heat generating portions being capable of generating heat by electric power supply between adjacent electrode portions; a first electroconductive line portion configured to electrically connect the first electrical contact and the first electrode portions; and a second electroconductive line portion configured to electrically connect one of the second electrical contacts and a part of the second electrode portions; wherein the heat generating portions are disposed so as to be offset from a center line of the substrate with respect to a widthwise direction of the substrate.

According to another aspect of the present invention, there is provided an image heating apparatus comprising: an electric energy supplying portion provided with a first terminal and a second terminal; a belt configured to heat an image on a sheet; a substrate provided inside the belt and extending in a widthwise direction of the belt; a first electrical contact provided on the substrate and electrically connectable with the first terminal; a plurality of second electrical contacts provided on the substrate and electrically connectable with the second terminal; a plurality of electrode portions including first electrode portions electrically connected with the first electrical contact and second electrode portions electrically connected with the second electrical contacts, the first electrode portions and the second electrode portions being arranged alternately with predetermined gaps in a longitudinal direction of the substrate; a plurality of heat generating portions provided between adjacent ones of the electrode portions so as to electrically connect between adjacent electrode portions, the heat generating portions being capable of generating heat by electric power supply between adjacent electrode portions; a first electroconductive line portion configured to electrically connect the first electrical contact and the first electrode portions; and a second electroconductive line portion configured to electrically connect one of the second electrical contacts and a part of the second electrode portions; and a third electroconductive line portion configured to electrically connect a second electrical contact different from the one of the second electrical contacts and a predetermined second electrode portion different from the part of the second electrode portions, wherein the electric energy supplying portion supplies electric power through the first electroconductive line portion and the second electroconductive line portion to heat generating portions, of the plurality of heat generating portions, in a first heat generating region along the longitudinal direction when a sheet having a predetermined width size narrower than a maximum width size of a sheet capable of being introduced into the image heating apparatus is heated, and supplies electric power through the first electroconductive line portion, the second electroconductive line portion and the third electroconductive line portion to heat generating portions, of the plurality of heat generating portions, which are disposed in the first heat generating region and which are disposed in a second heat generating region adjacent to the first heat generating region in the longitudinal direction when a sheet having a width size broader than the predetermined width size is heated, and wherein the heat generating portions are disposed so as to be offset from a center line of the substrate with respect to a widthwise direction of the substrate.

Further features of the present invention will become apparent from the following description of exemplary embodiments with reference to the attached drawings.

DESCRIPTION OF THE EMBODIMENTS

Embodiments of the present invention will be described in conjunction with the accompanying drawings. In this embodiment, the image forming apparatus is a laser beam printer using an electrophotographic process as an example. The laser beam printer will be simply called a printer.

Embodiment 1

Image Forming Portion

Figure 1:
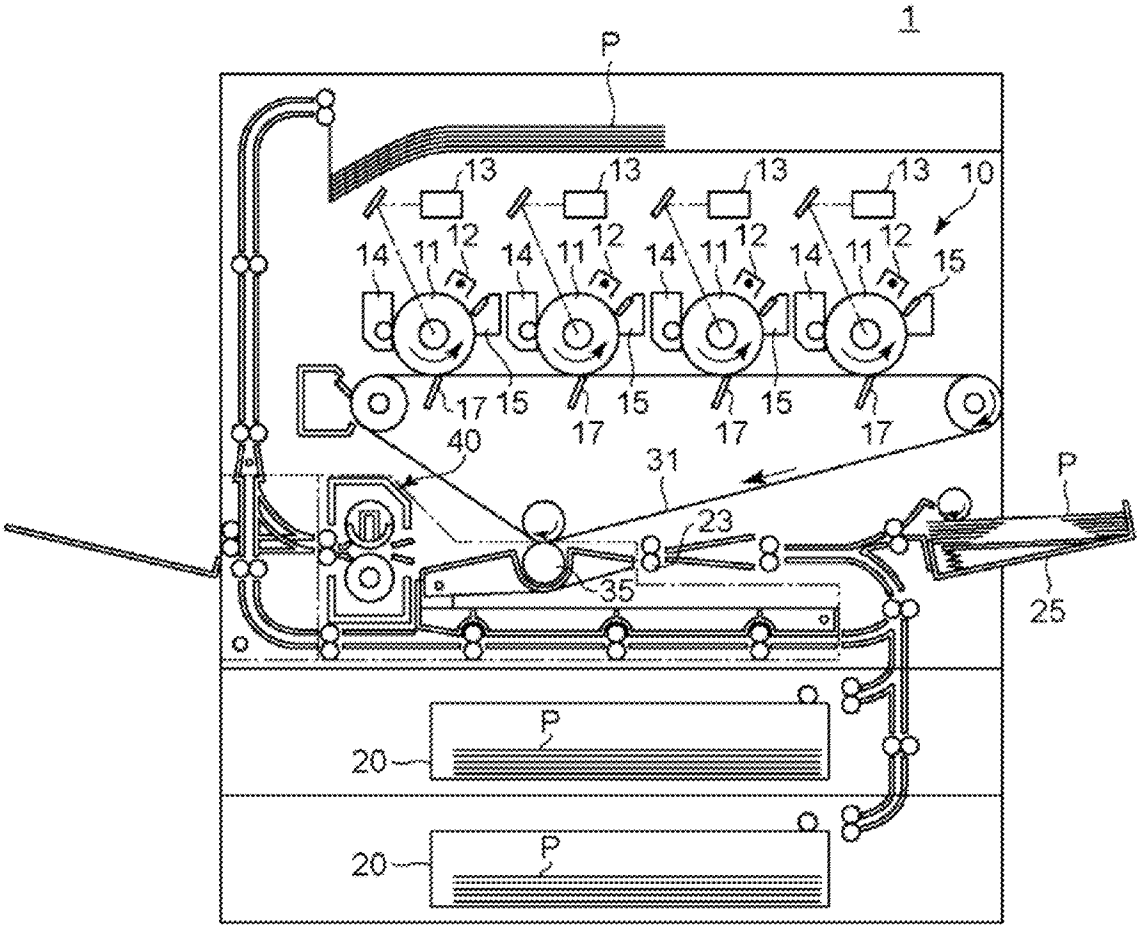
FIG. 1 is a schematic view showing a structure of an image forming apparatus.

FIG. 1 is a sectional view of the printer 1 which is the image forming apparatus of this embodiment. The printer 1 comprises an image forming station 10 and a fixing device 40, in which a toner image formed on the photosensitive drum 11 is transferred onto a sheet P, and is fixed on the sheet P, by which an image is formed on a sheet P. Referring to FIG. 1, the structures of the apparatus will be described in detail.

As shown in FIG. 1, the printer 1 includes image forming stations 10 for forming respective color toner images Y (yellow), M (magenta), C (cyan) and Bk (black). The image forming stations 10 include respective photosensitive drums 11 corresponding to Y, M, C, Bk colors are arranged in the order named from the left side. Around each photosensitive drum 11, similar elements provided as follows: a charger 12; an exposure device 13; a developing device 14; a primary transfer blade 17; and a cleaner 15. The structure for the Bk toner image formation will be described as a representative, and the descriptions for the other colors are omitted for simplicity by assigning the like reference numerals. So, the elements will be simply called photosensitive drum 11, charger 12, exposure device 13, developing device 14, primary transfer blade 17 and cleaner 15 with these reference numerals.

The photosensitive drum 11 as an electrophotographic photosensitive member is rotated by a driving source (unshown) in the direction indicated by an arrow (counterclockwise direction in FIG. 1). Around the photosensitive drum 11, the charger 12, the exposure device 13, the developing device 14, the primary transfer blade 17 and the cleaner 15 are provided in the order named.

A surface of the photosensitive drum 11 is electrically charged by the charger 12. Thereafter, the surface of the photosensitive drum 11 exposed to a laser beam in accordance with image information by the exposure device 13, so that an electrostatic latent image is formed. The electrostatic latent image is developed into a Bk toner image by the developing device 14. At this time, similar processes are carried out for the other colors. The toner image is transferred from the photosensitive drum 11 onto an intermediary transfer belt 31 by the primary transfer blade 17 sequentially (primary-transfer). The toner remaining on the photosensitive drum 11 after the primary-image transfer is removed by the cleaner 15. By this, the surface of the photosensitive drum 11 is cleaned so as to be prepared for the next image formation.

On the other hand, the sheet P contained in a feeding cassette 20 or placed on a multi-feeding tray 25 is picked up by a feeding mechanism (unshown) and fed to a pair of registration rollers 23. The sheet P is a member on which the image is formed. Specific examples of the sheet P is plain paper, thick sheet, resin material sheet, overhead projector film or the like. The pair of registration rollers 23 once stops the sheet P for correcting oblique feeding. The registration rollers 23 then feed the sheet P into between the intermediary transfer belt 31 and a secondary transfer roller 35 in timed relation with the toner image on the intermediary transfer belt 31. The secondary transfer roller 35 functions to transfer the color toner images from the intermediary transfer belt 31 onto the sheet P. Thereafter, the sheet P is fed into the fixing device (image heating apparatus) 40. The fixing device 40 applies heat and pressure to the toner image T on the sheet P to fix the toner image on the sheet P.

Figure 2:
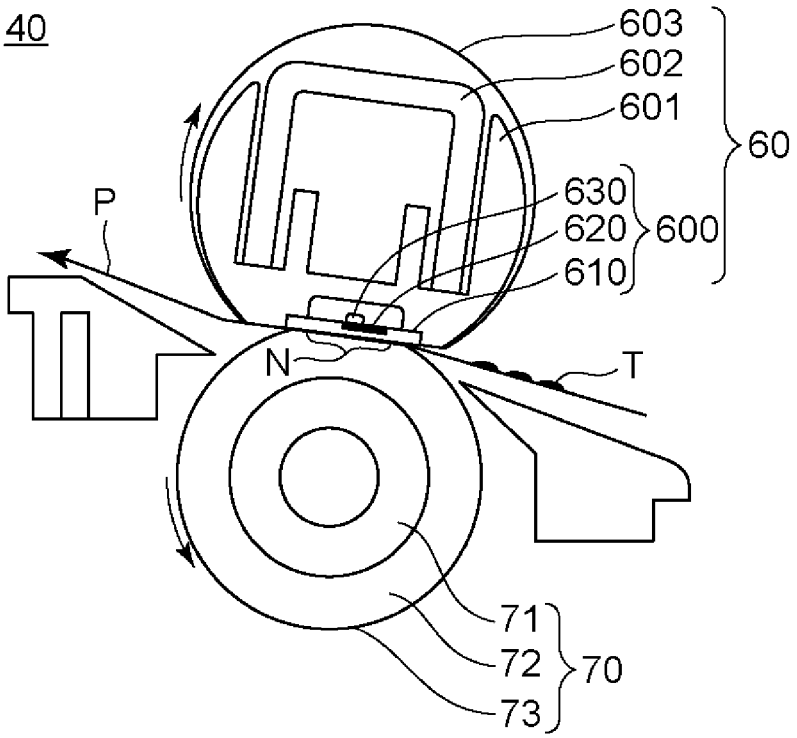
FIG. 2 is a sectional view of a fixing device with respect to a widthwise direction (short direction).
Figure 3:
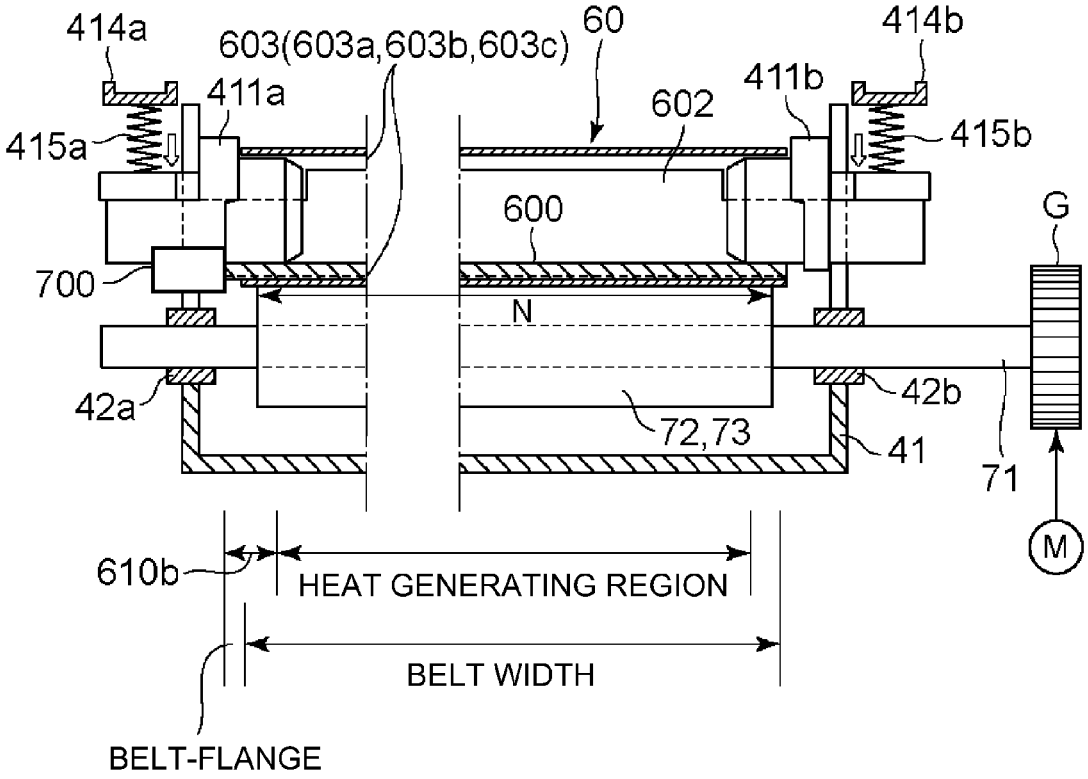
FIG. 3 is a sectional view of the fixing device with respect to a longitudinal direction (long direction).
Figure 4:
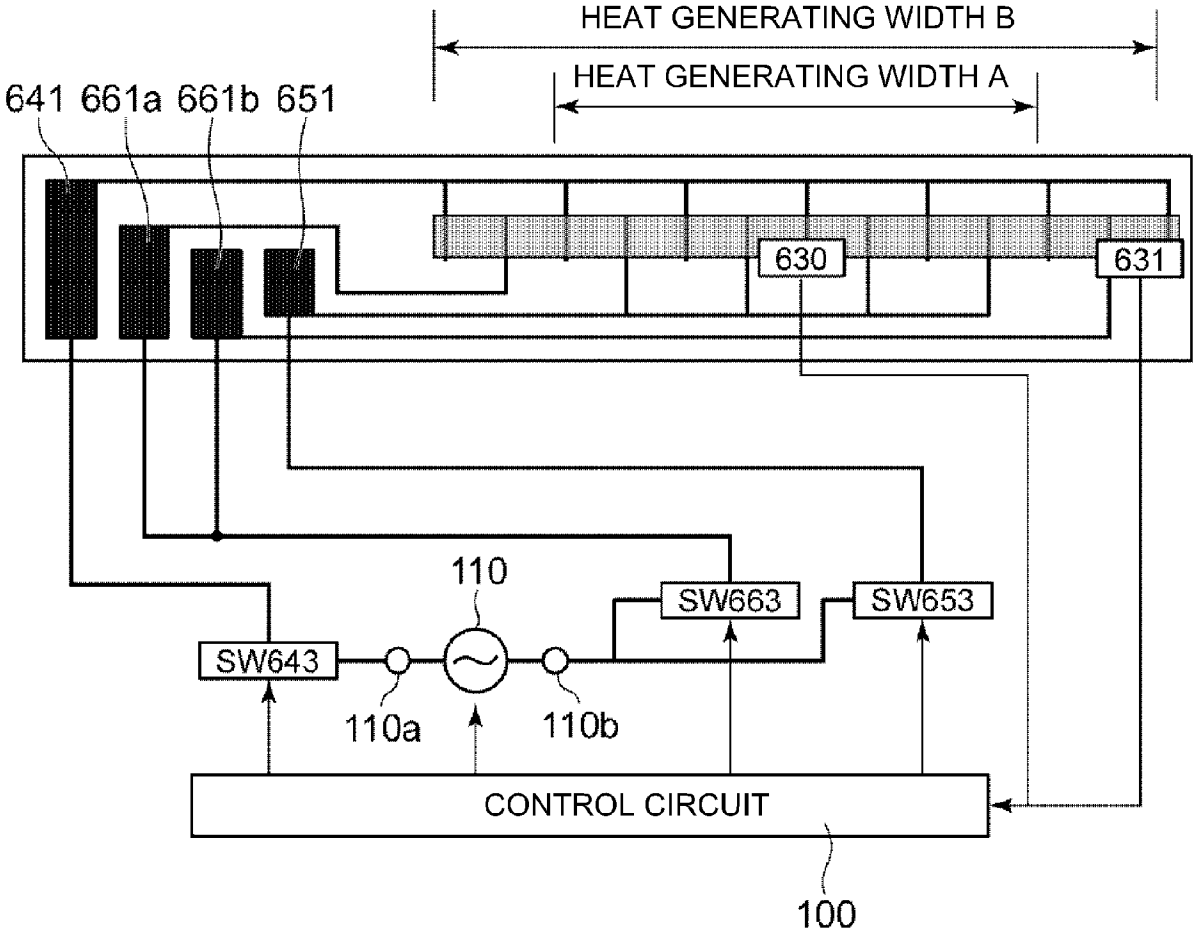
FIG. 4 is an illustration an electric energy (power) supplying constitution of a heater.
Figure 5:
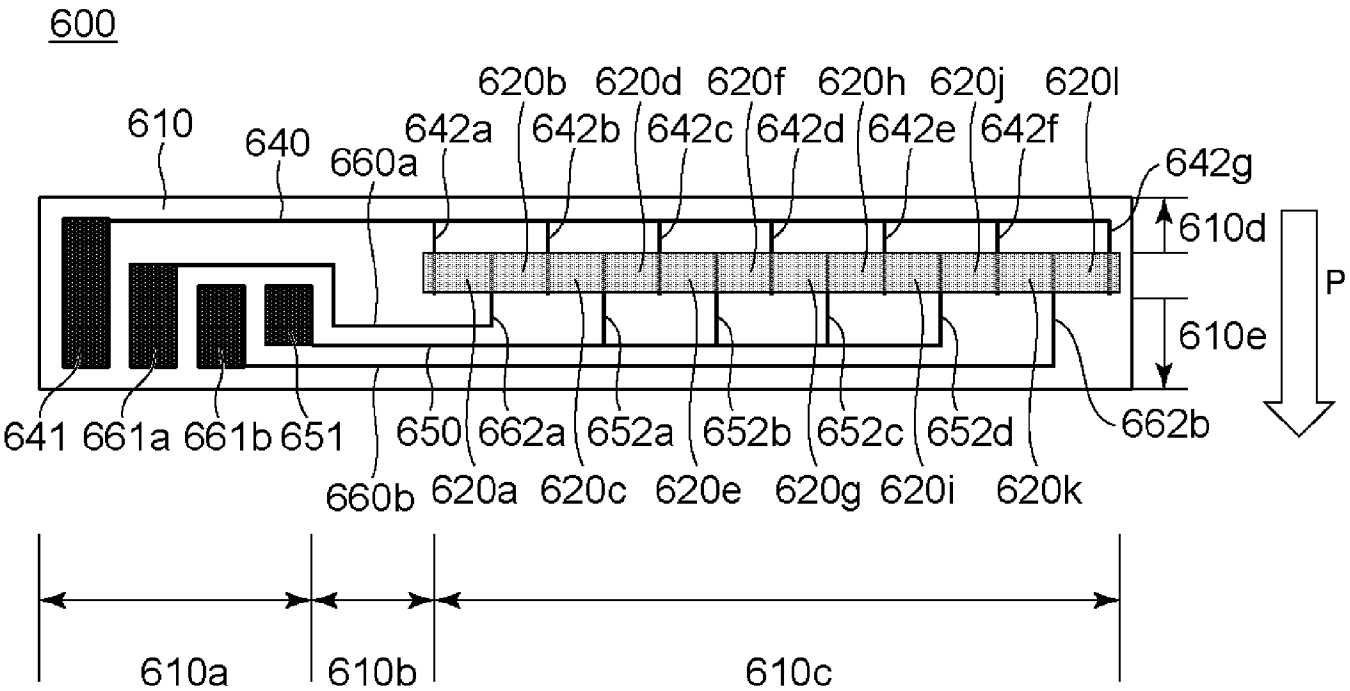
FIG. 5 is a structural view of the heater.

The fixing device 40 which is the image heating apparatus used in the printer 1 will be described. FIG. 2 is a sectional view of the fixing device 40 with respect to a widthwise direction (short direction). FIG. 3 is a sectional view of the fixing device 40 with respect to a longitudinal direction (long direction). FIG. 4 is an illustration of an electric energy (power) supplying constitution of a heater 600. FIG. 5 illustrates a structure of the heater 600.

The fixing device 40 is an image heating apparatus for heating the image on the sheet by a heater unit 60 (unit 60). The unit 60 includes a flexible thin fixing belt 603 (belt 603) and the heater 600 contacted to the inner surface of the belt 603 to heat the belt 603 (low thermal capacity structure). Therefore, the belt 603 can be efficiently heated, so that quick temperature rise at the start of the fixing operation is accomplished. As shown in FIG. 2, the belt 603 is nipped between the heater 600 and a pressing roller 70 (roller 70), by which a nip N is formed. The belt 603 rotates in the direction indicated by the arrow (clockwise in FIG. 2), and the roller 70 is rotated in the direction indicated by the arrow (counterclockwise in FIG. 2) to nip and feed the sheet P supplied to the nip N. At this time, the heat from the heater 600 is supplied to the sheet P through the belt 603, and therefore, the toner image T on the sheet P is heated and pressed by the nip N, so that the toner image is fixed on the sheet P by the heat and pressure. The sheet P having passed through the fixing nip N is separated from the belt 603 and is discharged. In this embodiment, the fixing process is carried out as described above. The structure of the fixing device 40 will be described in detail.

Unit 60 is a unit for heating and pressing an image on the sheet P. A longitudinal direction of the unit 60 is parallel with the longitudinal direction of the roller 70. The unit 60 comprises the heater 600, a heater holder 601, a support stay 602 and the belt 603.

The heater 600 is a heating member for heating the belt 603, slidably contacting with the inner surface of the belt 603. The heater 600 is pressed to the inside surface of the belt 603 toward the roller 70 so as to provide a desired nip width of the nip N. The heater 600 in this embodiment is 5-20 mm in width (the length in the up-down direction in FIG. 5), 350-400 mm in length (the length in the left-right direction in FIG. 5), and 0.5-2 mm in thickness. The heater 600 comprises a substrate 610 elongated in a direction perpendicular to the feeding direction of the sheet P (widthwise direction of the sheet P), and a heat generating resistor 620 (heat generating element 620) as a heat generating layer.

The heater 600 is fixed on the lower surface of the heater holder 601 along the longitudinal direction of the heater holder 601. In this embodiment, the heat generating element 620 is provided on the back side of the substrate 610 which is not in slidable contact with the belt 603, but the heat generating element 620 may be provided on the front surface of the substrate 610 which is in slidable contact with the belt 603. However, the heat generating element 620 of the heater 600 is preferably provided on the back side of the substrate 610, by which uniform heating effect to the substrate 610 is accomplished, from the standpoint of preventing non-uniform heat application to the belt 603. The details of the heater 600 will be described hereinafter.

The belt 603 is a cylindrical (endless) belt (film) for heating the image on the sheet in the nip N. The belt 603 comprises a base material 603*a*, an elastic layer 603*b* thereon, and a parting layer 603*c* on the elastic layer 603*b*, for example. The base material 603*a* may be made of metal material such as stainless steel or nickel, or a heat resistive resin material such as polyimide. The elastic layer 603*b* may be made of an elastic and heat resistive material such as a silicone rubber or a fluorine-containing rubber. The parting layer 603*c* may be made of fluorinated resin material or silicone resin material.

The belt 603 of this embodiment has dimensions of 30 mm in outer diameter, 330 mm in length (the dimension measured in the front-rear direction in FIG. 2), 30 μm in thickness, and the material of the base material 603*a* is nickel. The silicone rubber elastic layer 603*b* having a thickness of 400 μm is formed on the base material 603*a*, and a fluorine resin tube (parting layer 603*c*) having a thickness of 20 μm coats the elastic layer 603*b*.

The belt contacting surface of the substrate 610 may be provided with a polyimide layer having a thickness of 10 μm as a sliding layer. When the belt 603 is provided with the polyimide layer, the rubbing resistance between the belt 603 and the heater 600 is low, and therefore, the wearing of the inner surface of the belt 603 can be suppressed. In order to further enhance the slidability, a lubricant such as grease may be applied to the inner surface of the belt 603.

The heater holder 601 (holder 601) functions to hold the heater 600 in the state of urging the heater 600 toward the inner surface of the belt 603. The holder 601 has a curved shape at a contact surface thereof with the belt 603 and functions to regulate a rotation orbit of the belt 603. The holder 601 may be made of heat resistive resin material or the like. In this embodiment, it is Zenite 7755 (trade name) available from Dupont.

The support stay 602 supports the heater 600 by way of the holder 601. The support stay 602 is preferably made of a material which is not easily deformed even when a high pressure is applied thereto, and in this embodiment, it is made of SUS304 (stainless steel).

As shown in FIG. 3, the support stay 602 is supported by left and right flanges 411*a* and 411*b* at the opposite end portions with respect to the longitudinal direction. The flanges 411*a* and 411*b* may be simply called flange 411. The flange 411 regulates the movement of the belt 603 in the longitudinal direction and the circumferential direction configuration of the belt 603. The flange 411 is made of heat resistive resin material or the like. In this embodiment, it is PPS (polyphenylenesulfide resin material).

Between the flange 411*a* and a pressing arm 414*a*, an urging spring 415*a* is compressed. Also, between the flange 411*b* and a pressing arm 414*b*, an urging spring 415*b* is compressed. The urging springs 415*a* and 415*b* may be simply called urging spring 415. With such a structure, an elastic force of the urging spring 415 is applied to the heater 600 through the flange 411 and the support stay 602. The belt 603 is pressed against the upper surface of the roller 70 at a predetermined urging force to form the nip N having a predetermined nip width. In this embodiment, the pressure is 156.8 N (16 kgf) at one end portion side and 313.6 N (32 kgf) in total.

As shown in FIG. 3, a connector 700 is provided as an electric energy supply member electrically connected with the heater 600 to supply the electric power to the heater 600. The connector 700 is detachably provided at one longitudinal end portion of the heater 600. The connector 700 is easily detachably mounted to the heater 600, and therefore, assembling of the fixing device 40 and the exchange of the heater 600 or belt 603 upon damage of the heater 600 is easy, thus providing good maintenance property. Details of the connector 700 will be described hereinafter.

As shown in FIG. 2, the roller 70 is a nip forming member which contacts an outer surface of the belt 603 to cooperate with the belt 603 to form the nip N. The roller 70 has a multi-layer structure on a metal core 71 of metal material, the multi-layer structure including an elastic layer 72 on the metal core 71 and a parting layer 73 on the elastic layer 72. Examples of the materials of the metal core 71 include SUS (stainless steel), SUM (sulfur and sulfur-containing free-machining steel), Al (aluminum) or the like. Examples of the materials of the elastic layer 72 include an elastic solid rubber layer, an elastic foam rubber layer, an elastic porous rubber layer or the like. Examples of the materials of the parting layer 73 include fluorinated resin material.

The roller 70 of this embodiment includes a metal core 71 of steel, an elastic layer 72 of silicone rubber foam on the metal core 71, and a parting layer 73 of fluorine resin tube on the elastic layer 72. Dimensions of the portion of the roller 70 having the elastic layer 72 and the parting layer 73 are 30 mm in outer diameter, and 330 mm in length.

As shown in FIG. 3, the metal core 71 of the roller 70 is rotatably held by bearings 42*a* and 42*b* provided in a rear side and a front side of a side plate 41, respectively. One axial end of the metal core 71 is provided with a gear G to transmit the driving force from a motor M to the metal core 71 of the roller 70. As shown in FIG. 2, the roller 70 receiving the driving force from the motor M rotates in the direction indicated by the arrow (clockwise direction). In the nip N, the driving force is transmitted to the belt 603 by the way of the roller 70, so that the belt 603 is rotated in the direction indicated by the arrow (counterclockwise direction). The roller 70 functions as a rotatable feeding member for feeding the sheet P, nipped at the nip N, from an upstream side to a downstream side.

A control circuit 100 is a circuit including a CPU for performing computation with various pieces of control and a nonvolatile medium such as an ROM storing various programs. In the ROM, the programs are stored, and are read and executed by the CPU, so that the various pieces of control are executed. As the control circuit 100, an integrated circuit such as ASIC may also be used if the integrated circuit performs a similar function.

As shown in FIG. 4, the control circuit 100 is electrically connected with a power source circuit 110 so as to control energization content of the power source circuit 110. The control circuit 100 is electrically connected with a main thermistor 630 so as to obtain an output of the main thermistor 630. The control circuit 100 is electrically connected with the main thermistor 630 so as to obtain an output of a sub-thermistor 631. The control circuit 100 is electrically connected with the motor M to control the electric power supply to the motor M.

The motor M is a driving means for driving the roller 70 via the gear G. When the electric energy is supplied by the control of the control circuit 100, the motor M starts to rotate (drive) the gear G. The control circuit 100 controls the rotation of the motor M. The control circuit 100 rotates the roller 70 and the belt 603 using the motor M at a predetermined speed. It controls the motor so that the speed of the sheet P nipped and fed by the nip N in the fixing process operation is the same as a predetermined process speed (200 [mm/sec], for example).

The main thermistor 630 is a temperature sensor provided in the neighborhood of a longitudinal central portion on a rear side (opposite from a sliding surface) of the heater 600. The main thermistor 630 is bonded to the heater 600 in a state in which the main thermistor 630 is insulated from the heat generating element 620. The main thermistor 630 performs the function of detecting a temperature of the heater 600. As shown in FIG. 4, the main thermistor 630 is connected with the control circuit 100 via an A/D converter (not shown), and sends an output depending on a detected temperature to the control circuit 100.

The control circuit 100 reflects temperature information obtained from the main thermistor 600 in energization control of the power source circuit 110. That is, the control circuit 100 controls, on the basis of the output of the main thermistor 630, electric power (energy) supplied to the heater 600 via the power source circuit 110. In this embodiment, the control circuit 100 effects wave-number control of an output of the power source circuit 110, and thus adjusts an amount of heat generation of the heater 600. By effecting such control, the temperature of the heater 630 is maintained constantly at a predetermined temperature (e.g., 200° C.) when the fixing process is performed.

The sub-thermistor 631 is provided at an end portion of a heat generating width A (FIG. 4) on the rear side of the heater 600. The sub-thermistor 631 is disposed in such a manner, so that in the case where an A4-sized sheet as the sheet P is subjected to short edge feeding or in the case where an A5-sized sheet as the sheet P is subjected to long edge feeding, the sub-thermistor 631 is capable of detecting a temperature of a region where the sheet P is not passed in the longitudinal direction of the heater 600. In the case where the detected temperature of the sub-thermistor 631 exceeds a predetermined value (e.g., 270° C.), a feeding interval of the sheet P is increased to lower a throughput, whereby control such that a non-sheet-passing portion temperature rise of the sheet P is suppressed. That is, the control circuit 100 changes a printing speed on the basis of temperature information obtained from the sub-thermistor 631 and reflects the temperature information in various pieces of control of the printer 1.

[Heater]

Figure 9:
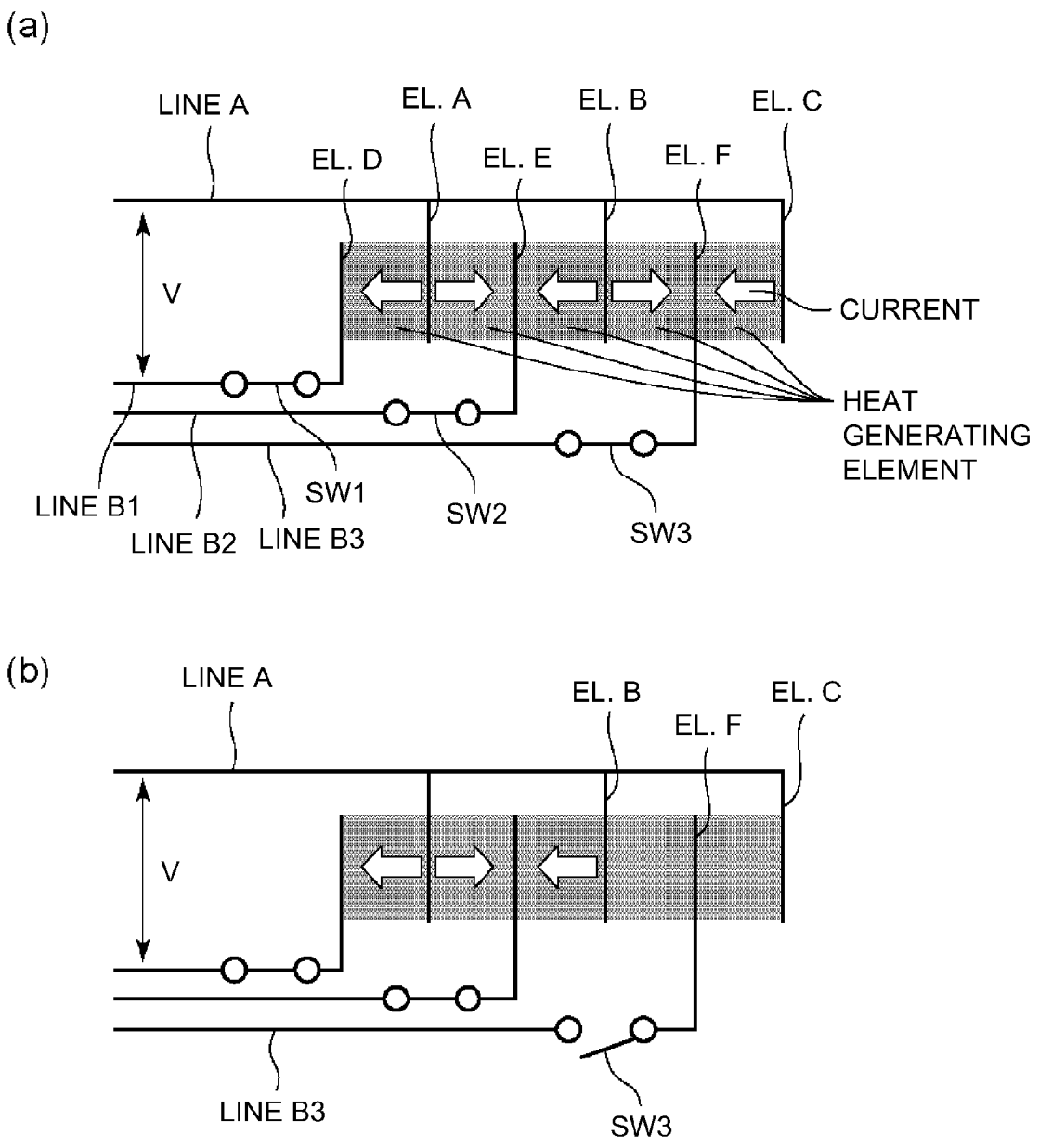
In FIG. 9, (a) illustrates a system for supplying electric energy to a heater, and (b) illustrates a system for switching a heat generating region of the heater.
Figure 10:
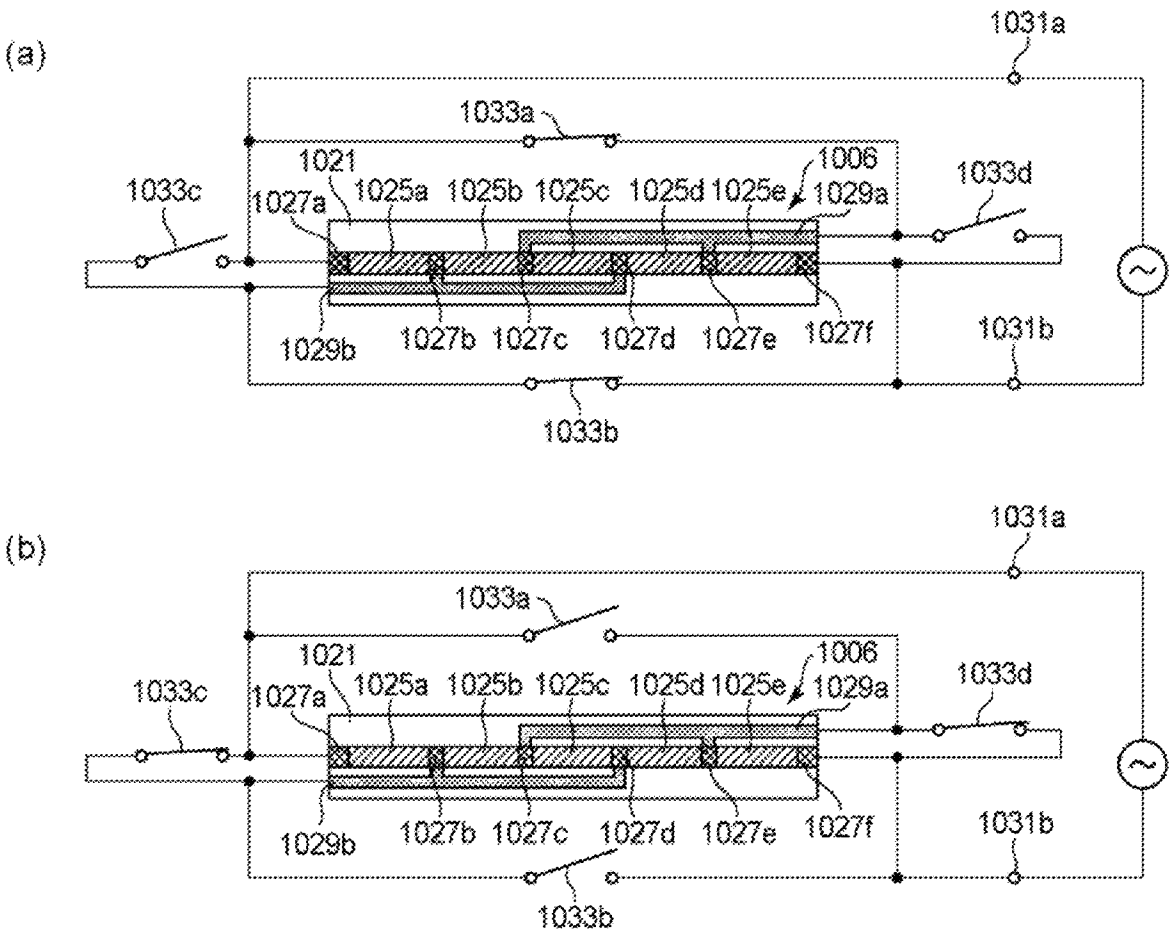
In FIG. 10, (a) is a circuit diagram of a heater for a large-sized sheet, and (b) is a circuit diagram of the heater for a small-sized sheet.

The structure of the heater 600 used in the fixing device 40 will be described in detail. In FIG. 9, (a) illustrates a heat generating type used in the heater 600, and (b) illustrates a heat generating region switching type used with the heater 600. In the following description, with respect to the fixing device 40 and members constituting the fixing device 40, the longitudinal direction (long direction) is a direction (left-right direction in FIG. 3) perpendicular to a (sheet) feeding direction in a plane of the sheet P. The widthwise direction (short direction) is a direction (up-down direction in FIG. 5) parallel to the feeding direction in the plane of the sheet P. A front surface (side) of the fixing device 40 is a surface (side) when the fixing device 40 is seen from a sheet entrance side, and a rear surface (side) is a surface (side) when the fixing device 40 is seen from a sheet exit side opposite from the sheet entrance side. Left and right of the fixing device 40 are those when the fixing device 40 is seen from the front surface (FIG. 3). The upstream side and the downstream side are those with respect to the sheet feeding direction.

The heater 600 of this embodiment is a heater using the heat generating type shown in (a) and (b) of FIG. 9. As shown in (a) of FIG. 9, electrodes EL.A-EL.C are electrically connected with A-electroconductive-line ("LINE A"), and electrodes EL.D-EL.F are electrically connected with B-electroconductive-line ("LINE B1", "LINE B2", "LINE B3"). The electrodes EL.A-EL.C connected with the A-electroconductive-lines and the electrodes EL.D-EL.F connected with the B-electroconductive-lines are interlaced (alternately arranged) along the longitudinal direction (left-right direction in (a) of FIG. 9), and heat generating elements are electrically connected between the adjacent electrodes. The electrodes and the electroconductive lines are electroconductive patterns (lead wires) formed in a similar manner. In this embodiment, the lead wire portion, extending in the widthwise direction (short direction), for being electrically connected with the heat generating element is referred to as the electrode, and the lead wire portion, extending in the longitudinal direction (long direction), performing the function of connecting a portion, to which the voltage is applied, with the electrode is referred to as the electroconductive line (electric power supplying line). When a voltage V is applied between the A-electroconductive-line and the B-electroconductive-line, a potential difference is generated between the adjacent electrodes. As a result, electric currents flow through the heat generating elements, and the directions of the electric currents through the adjacent heat generating elements are opposite to each other. In this type heater, the heat is generated in the above-described manner. As shown in (b) of FIG. 9, the B3-electroconductive-line is provided with a switch SW3, and when the switch SW3 is opened to disconnect the B3-electroconductive-line and the electrode EL.F, the electrode EL.B and the electrode EL.C are at the same potential, and therefore, no electric current flows through the heat generating elements therebetween. In this system, the heat generating elements arranged in the longitudinal direction are independently energized so that only a part of the heat generating elements can be energized by switching off a part of the B-electroconductive-line branching into a plurality of electroconductive lines (LINE B1, LINE B2, LINE B3). In other words, in the system, the heat generating region can be changed by providing switches SW1, SW2, SW3 in the electroconductive lines (LINE B1, LINE B2, LINE B3). In the heater 600, the heat generating region of the heat generating element 620 can be changed using the above-described system.

The heat generating element generating Joule heat generates heat when energized, irrespective of the direction of the electric current, but it is preferable that the heat generating elements and the electrodes are arranged so that the currents flow along the longitudinal direction. Such an arrangement is advantageous over the arrangement in which the directions of the electric currents are in the widthwise direction perpendicular to the longitudinal direction (up-down direction in (a) of FIG. 9) in the following point. When joule heat generation is effected by the electric energization of the heat generating element, the heat generating element generates heat correspondingly to the resistance (value) thereof, and therefore, the dimension and the material of the heat generating element are selected in accordance with the direction of the electric current so that the resistance is at a desired level. The dimension of the substrate on which the heat generating element is provided is very short in the widthwise direction as compared with that in the longitudinal direction. Therefore, if the electric current flows in the widthwise direction, it is difficult to provide the heat generating element with a desired resistance, using a low resistance material. On the other hand, when the electric current flows in the longitudinal direction, it is relatively easy to provide the heat generating element with a desired resistance, using the low resistance material. In addition, when a high resistance material is used for the heat generating element, a temperature non-uniformity may result from non-uniformity in the thickness of the heat generating element when it is energized.

For example, when the heat generating element material is applied on the substrate along the longitudinal direction by screen printing or the like, a thickness non-uniformity of about 5% may result in the widthwise direction. This is because a heat generating element material painting non-uniformity occurs due to a small pressure difference in the widthwise direction by a painting blade. For this reason, it is preferable that the heat generating elements and the electrodes are arranged so that the electric currents flow in the longitudinal direction.

In the case that the electric power is supplied individually to the heat generating elements arranged in the longitudinal direction, it is preferable that the electrodes and the heat generating elements are disposed such that the directions of the electric current flow alternates between adjacent ones. As to the arrangements of the heat generating elements and the electrodes, it would be considered to arrange the heat generating elements each connected with the electrodes at the opposite ends thereof, in the longitudinal direction, and the electric power is supplied in the longitudinal direction. However, with such an arrangement, two electrodes are provided between adjacent heat generating elements, with the result of the likelihood of short circuit. In addition, the number of required electrodes is large with the result of large non-heat generating portion between the heat generating elements. Therefore, it is preferable to arrange the heat generating elements and the electrodes such that an electrode is made common between adjacent heat generating elements. With such an arrangement, the likelihood of the short circuit between the electrodes can be avoided, and a space between the electrodes can be eliminated.

In this embodiment, a common energization electroconductive line 640 shown in FIG. 5 corresponds to A-electroconductive-line of (a) of FIG. 9, and opposite energization electroconductive lines 650, 660*a*, 660*b* shown in FIG. 5 correspond to the B-electroconductive-lines in (a) of FIG. 9. In addition, common electrodes 642*a*-642*g* as a first electrode layer of FIG. 5 correspond to electrodes EL.A-EL.C of (a) of FIG. 9, and opposite electrodes 652*a*-652*d*, 662*a*, 662*b* as a second electrode layer correspond to electrodes EL.D-EL.F. Heat generating elements 620*a*-620*l* correspond to the heat generating elements of (a) of FIG. 9. Hereinafter, the common electrodes 642*a*-642*g* are simply called a common electrode 642. The opposite electrodes 652*a*-652*d* are simply called an electrode 652. The opposite electrodes 662*a*, 662*b* are simply called an electrode 662. The opposite energization electroconductive lines 660*a*, 660*b* are simply called an electroconductive line 660. The heat generating elements 620*a*-620*l* are simply called a heat generating element 620. The structure of the heater 600 will be described in detail referring to the accompanying drawings.

Figure 6:
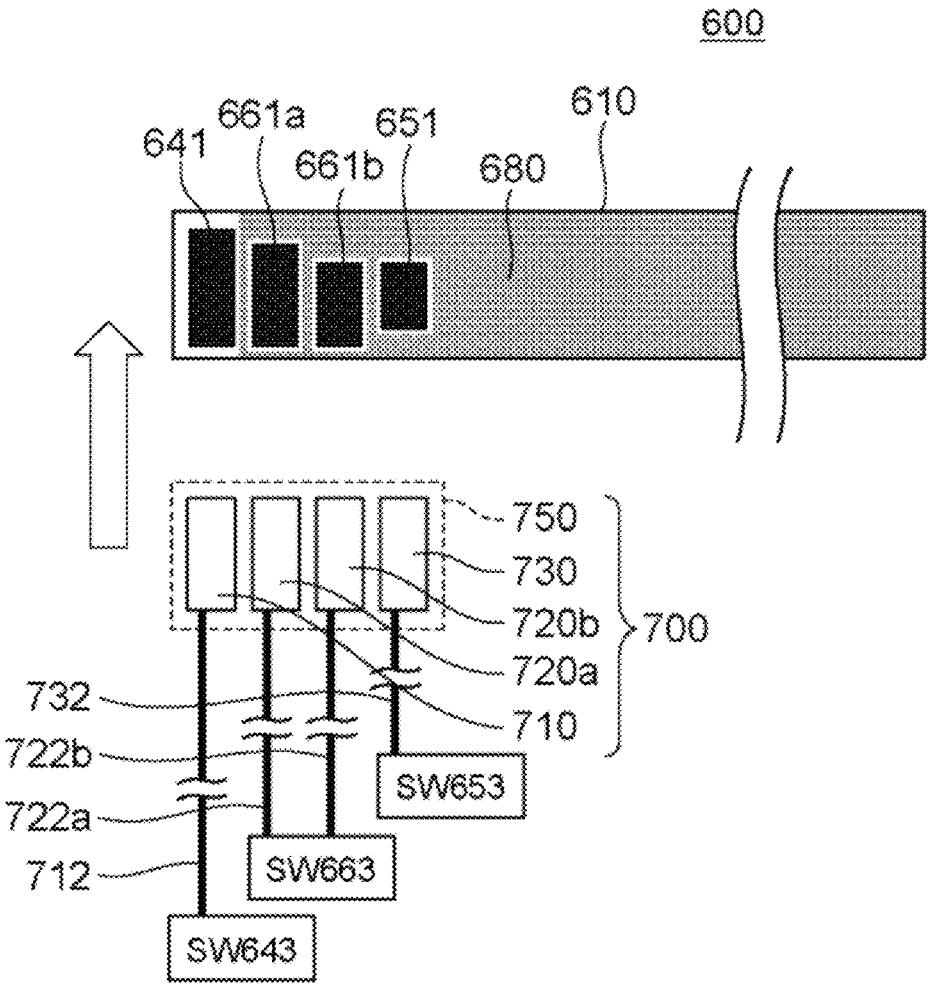
FIG. 6 is a schematic view for illustrating a connector.

As shown in FIG. 6, the heater 600 comprises the substrate 610, the heat generating element 620 on the substrate 610, an electroconductor pattern (energization electroconductive line), and an insulation coating layer 680 covering the heat generating element 620 and the electroconductor pattern (energization electroconductive line).

The substrate 610 determines the dimensions and the configuration of the heater 600 and is a member contacting an inner surface of the belt 603 along the longitudinal direction of the substrate 610 so as to sandwich the belt 603 in cooperation with the roller 70. The material for the substrate 610 is a ceramic material such as alumina, aluminum nitride or the like, which has high heat resistivity, thermo-conductivity, electrical insulative property or the like. In this embodiment, the substrate 610 is a plate member of alumina having a length in the longitudinal direction (left-right direction in FIG. 5) of 380 mm, a width with respect to the widthwise direction (up-down direction in FIG. 5) of 9 mm and a thickness of 1 mm. The alumina plate member is 30 W/m.K in thermal conductivity.

On the back surface (side) of the substrate 610, the heat generating element 620 and the electroconductor pattern (energization electroconductive line) are provided through thick film printing method (screen printing method) using an electroconductive thick film paste. In this embodiment, a silver paste is used for the electroconductor pattern so that the resistivity is low, and a silver-palladium alloy paste is used for the heat generating element 620 so that the resistivity is high. As a paste for forming the heat generating element a ruthenium oxide paste or the like may also be used. As shown in FIG. 6, the heat generating element 620 and the electroconductor pattern coated with the insulation coating layer 680 of heat resistive glass so that they are electrically protected from leakage and short circuit.

As shown in FIG. 5, there are provided electrical contacts 641, 651, 661*a*, 661*b* as a part of the electroconductor pattern in one end portion side of the substrate 610 with respect to the longitudinal direction. In addition, there are provided the heat generating element 620, the electrodes 642*a*-642*g* and the electrodes 652*a*-652*e*, 662*a*, 662*b* as a part of the electroconductor pattern in the other end portion side of the substrate 610 with respect to the longitudinal direction of the substrate 610. Between the one end (portion) side 610*a* of the substrate and the other end portion side 610*c*, a middle region 610*b* is provided.

Further, as shown in FIG. 5, in one end portion side 610*d* of substrate 610 beyond the heat generating element 620 with respect to the widthwise direction, the electroconductive line 640 consisting of a single line as a part of the electroconductor pattern is provided. In the other end (portion) side 610*e* of the substrate 610 beyond the heat generating element 620 with respect to the widthwise direction, the electroconductive lines 650 and 660 consisting of a plurality of lines are provided as a part of the electroconductor pattern. In the case where the above-described structure is intended to be disposed in a limited space on the substrate 610, the heat generating element 620 is disposed so as to be offset from a center line of the substrate 610 with respect to the widthwise direction of the substrate 610. This is because the electroconductive line 640 is the single line and on the other hand, the electroconductive lines 650, 660 are the plurality of lines and require a broad disposing space.

In this embodiment, with respect to a length (width) of 9 mm of the substrate 610 with respect to the widthwise direction of the substrate 610, the width (widthwise length) of the heat generating element 620 was 2 mm, the width of the substrate 610 in the one end side 610*a* was 2 mm, and the width of the substrate 610 in the other end side 610*e* was 5 mm. That is, the heat generating element 620 is offset from the center line toward the electroconductive line 640 side by 1.5 mm with respect to the widthwise direction of the substrate 610.

The heat generating element 620 (620*a*-620*l*) is a resistor capable of generating joule heat by electric power supply (energization). The heat generating element 620 is one heat generating element member extending in the longitudinal direction on the substrate 610. The heat generating element 620 has a desired resistance value, and has the width (measured in the widthwise direction of the substrate 610) of 1-4 mm, a thickness of 5-20 μm. The heat generating element 620 in this embodiment has the width of 2 mm and the thickness of 10 μm. A total length of the heat generating element 620 in the longitudinal direction is 320 mm, in which the A4-sized sheet P (297 mm in width) is heatable.

On the heat generating element 620, seven electrodes 642*a*-642*g* which will be described hereinafter are laminated with intervals in the longitudinal direction. In other words, the heat generating element 620 is isolated into six sections by the electrodes 642*a*-642*g* along the longitudinal direction. On central portions of the respective sections of the heat generating element 620, one of the six electrodes 652, 662 (652*a*-652*d*, 662*a*, 662*b*) are laminated. In this manner, the heat generating element 620 is divided into 12 sub-sections. The heat generating element 620 divided into 12 sub-sections can be deemed as a plurality of heat generating elements 620*a*-620*l*. In other words, the heat generating elements 620*a*-620*l* electrically connect adjacent electrodes with each other. With such a structure, the heat generating element 620 is capable of generating heat in a partial area or areas with respect to the longitudinal direction.

The heat generating elements 620 are formed so that resistance value thereof with respect to the longitudinal direction are uniform, and in this embodiment, the resistance values are 92.4Ω. The longitudinal dimension of the heat generating elements 620*a*, 620*b*, 620*k*, 620*l* is 25 mm, and the longitudinal dimension of the heat generating elements 620*c*-620*j* is 27.5 mm. This is because the longitudinal dimension (220 mm) of the heat generating width A (FIG. 4) consisting of the heat generating elements 620*c*-620*j* is a dimension suitable for heating the small-sized sheet P of 210 mm in width size. In addition, the dimension of the heat generating elements 620*a*, 620*b*, 620*k*, 620*l* is made shorter than the dimension of the heat generating elements 620*c*-620*j*, whereby an amount of heat generation of the heat generating element 620 at longitudinal end portions is made large and thus it is also possible to prevent temperature change at the longitudinal end portions of the heat generating element 620 due to heat dissipation. At positions where the electrodes 642, 652, 662 are formed, the heat generating elements 620 substantially generate no heat. However, there is a heat-uniformizing action on the substrate 610, and therefore by suppressing a thickness of the electrodes to 1 mm or less, so that the influence on the fixing process is at a negligible level. The thickness of each of the electrodes in this embodiment is 1 mm or less.

The electrodes 642 (642*a*-642*g*) are a part of the above-described electroconductor pattern. The electrode 642 extends in the widthwise direction of the substrate 610 perpendicular to the longitudinal direction of the heat generating element 620. In this embodiment, the electrode 642 is laminated on the heat generating element 620. The electrodes 642 are odd-numbered electrodes of the electrodes connected to the heat generating element 620, as counted from a one longitudinal end of the heat generating element 620. The electrode 642 is connected to one contact 110*a* of the power (voltage) source circuit 110 through the electroconductive line 640 which consists of the single line and which will be described hereinafter.

The electrodes 652, 662 are a part of the above-described electroconductor pattern. The electrodes 652, 662 extend in the widthwise direction of the substrate 610 perpendicular to the longitudinal direction of the heat generating element 620. The electrodes 652, 662 are the other electrodes of the electrodes connected with the heat generating element 620 other than the above-described electrode 642. That is, in this embodiment, they are even-numbered electrodes as counted from the one longitudinal end of the heat generating element 620.

That is, the electrode 642 and the electrodes 662, 652 are alternately arranged along the longitudinal direction of the heat generating element 620. The electrodes 652, 662 are connected to another contact 110*b* of the power source circuit 110 through the opposite electroconductive lines 650, 660 which consists of the plurality of lines and which will be described hereinafter.

The electrode 642 and the electrodes 652, 662 function as electrode portions for supplying the electric power to the heat generating element 620. In this embodiment, the odd-numbered electrodes are described as the electrodes 642, and the even-numbered electrodes are described as the electrodes 652, 662, but the structure of the heater 600 is not limited to this example. For example, the even-numbered electrodes may be the electrode 642, and the odd-numbered electrodes may be the electrodes 652, 662.

In addition, in this embodiment, four of the all opposite electrodes connected with the heat generating element 620 are the opposite electrode 652. In this embodiment, two of the all opposite electrodes connected with the heat generating element 620 are the opposite electrode 662. However, the allotment of the opposite electrodes is not limited to this example, but may be changed depending on the heat generation widths of the heater 600. For example, two may be the opposite electrode 652, and four maybe the opposite electrode 662.

The electroconductive line 640 as a first electroconductive line is a part of the above-described electroconductor pattern. The electroconductive line 640 extends along the longitudinal direction of the substrate 610 toward the one end (portion) side 610*a* of the substrate 610 in the one end (portion) side 610*e* of the substrate 610 with respect to the widthwise direction. The electroconductive line 640 is connected with the electrodes 642 (642*a*-642*g*) which is in turn connected with the heat generating element 620 (620*a*-620*l*). The electroconductive line 640 is connected to the electrical contact 641 which will be described hereinafter. In this embodiment, in a region where the heat generating elements 620 and the electroconductive line 640 are arranged, the width of the electroconductive line 640 with respect to the widthwise direction (short direction) of the substrate 610 is 1 mm, and a spacing of 0.5 mm for insulation is provided at each of both sides of the electroconductive line 640 with respect to the widthwise direction. Accordingly, the width of the substrate 610 in the one end side 610*d* with respect to the widthwise direction is 2 mm.

The opposite electroconductive line 650 as a second electroconductive line is a part of the above-described electroconductor pattern. The electroconductive line 650 extends along the longitudinal direction of substrate 610 toward the one end portion side 610*a* of the substrate 610 in the other end (portion) side 610*e* of the substrate 610 with respect to the widthwise direction. The electroconductive line 650 is connected with the electrodes 652 (652*a*-652*d*) which are in turn connected with heat generating elements 620 (620*c*-620*j*). The opposite electroconductive line 650 is connected to the electrical contact 651 which will be described hereinafter.

The electroconductive line 660 (660*a*, 660*b*) is a part of the above-described electroconductor pattern. The electroconductive line 660*a* as a third electroconductive line extends along the longitudinal direction of substrate 610 toward the one end portion side 610*a* of the substrate 610 in the other end portion side 610*e* of the substrate 610 with respect to the widthwise direction. The electroconductive line 660*a* is connected with the electrode 662*a* which is in turn connected with the heat generating element 620 (620*a*, 620*b*). The electroconductive line 660*a* is connected to the electrical contact 661*a* which will be described hereinafter. The electroconductive line 660*b* extends along the longitudinal direction of substrate 610 toward the one end portion side 610*a* of the substrate 610 in the other end portion side 610*e* of the substrate 610 with respect to the widthwise direction. The electroconductive line 660*b* is connected with the opposite electrode 662*b* which is in turn connected with the heat generating element 620. The electroconductive line 660*b* is connected to the electrical contact 661*b* which will be described hereinafter. In this embodiment, in a region where the heat generating elements 620 and the electroconductive lines 650*a*, 660*a*, 660*b* are arranged, the width of each of the electroconductive lines 650*a*, 660*a*, 660*b* with respect to the widthwise direction (short direction) of the substrate 610 is 1 mm. A spacing of 0.5 mm for insulation is provided at each of both sides of the electroconductive lines 650*a*, 660*a*, 660*b* with respect to the widthwise direction. Accordingly, the width of the substrate 610 in the other end side 610*e* with respect to the widthwise direction is 5 mm.

The width of each of the electroconductive line 640 and the electroconductive lines 650, 660*a*, 660*b* is not limited to those in this embodiment. The electroconductive line 640 through which a current corresponding to currents flowing through the electroconductive lines 650, 660*a*, 660*b* concentratedly flows may also have a width broader than the width of the electroconductive lines 650, 660*a*, 660*b* in order to suppress unnecessary heat generation. In this case, the width of the electroconductive line 640 is sufficient if the width is a total width of the electroconductive lines 650, 660*a*, 660*b* at the maximum. Accordingly, even in the case where the width of the electroconductive line 640 is large, the other end side 610*e* of the substrate 610 where the plurality of electroconductive lines 650, 660*a*, 660*b* are arranged with a plurality of insulating intervals still requires a larger space than the one end side 610*d* of the substrate 610.

The electrical contacts 641, 651, 661 (661*a*, 661*b*) are a part of the above-described electroconductor pattern. Each of the electrical contacts 641, 651, 661 preferably has an area of not less than 2.5 mm×2.5 mm in order to assure the reception of the electric power supply from the connector 700 which will be described hereinafter. In this embodiment, the electrical contacts 641, 651, 661 has a length 3 mm measured in the longitudinal direction of the substrate 610 and a width of not less than 2.5 mm measured in the widthwise direction of the substrate 610. The electrical contacts 641, 651, 661*a*, 661*b* are disposed in the one end portion side 610*a* of the substrate 610 beyond the heat generating element 620 with gaps of 4 mm in the longitudinal direction of the substrate 610. As shown in FIG. 6, no insulation coating layer 680 is provided at the positions of the electrical contacts 641, 651, 661*a*, 661*b* so that the electrical contacts 641, 651, 661*a*, 661*b* are exposed. The electrical contacts 641, 651, 661*a*, 661*b* are exposed on a region 610*a* which is projected beyond an edge of the belt 603 with respect to the longitudinal direction of the substrate 610. Therefore, the electrical contacts 641, 651, 661*a*, 661*b* are contactable to the connector 700 to establish electrical connection therewith.

When voltage is applied between the electrical contact 641 and the electrical contact 651 via the electroconductive lines 640 and 650 through the connection between the heater 600 and the connector 700, a potential difference is produced between the electrode 642 (642*b*-642*f*) and the electrode 652 (652*a*-652*d*). Therefore, through the heat generating elements 620*c*, 620*d*, 620*e*, 620*f*, 620*g*, 620*h*, 620*i*, 620*j*, the currents flow along the longitudinal direction of the substrate 610, the directions of the currents through the adjacent heat generating elements being substantially opposite to each other. Then, each of the heat generating elements 620*c*, 620*d*, 620*e*, 620*f*, 620, 620*h*, 620*i*, 620*j* as a first heat generating region generates heat.

When voltage is applied between the electrical contact 641 and the electrical contact 661*a* via the electroconductive lines 640 and 660*a* through the connection between the heater 600 and the connector 700, a potential difference is produced between the electrodes 642*a*, 642*b* and the electrode 662*a*. Therefore, through the heat generating elements 620*a*, 620*b*, the currents flow along the longitudinal direction of the substrate 610, the directions of the currents through the adjacent heat generating elements being opposite to each other. Then, each of the heat generating elements 620*a*, 620*b* as a second heat generating region adjacent to the first heat generating region generates heat.

When voltage is applied between the electrical contact 641 and the electrical contact 661*b* through the connection between the heater 600 and the connector 700, a potential difference is produced between the electrodes 642 and the electrode 662*b* through the electroconductive line 640 and the electroconductive line 660*b*. Therefore, through the heat generating elements 620*k*, 620*l*, the currents flow along the longitudinal direction of the substrate 610, the directions of the currents through the adjacent heat generating elements being opposite to each other. Then, each of the heat generating elements 620*k*, 620*l* as a third heat generating region adjacent to the first heat generating region generates heat.

In this way, by selecting the electrical contacts to which the voltage is to be applied, the heater 600 can selectively energize the heat generating elements, to be intended to be caused to generate heat, from the heat generating elements 620*a*-620*l*.

The middle region 610*b* is provided between the one end side 610*a* and the other end side 610*c* of the substrate 610. Specifically, in this embodiment, a region between the electrode 642*a* of the substrate 610 and the electrical contact 651 is the middle region 610*b*. The middle region 610*b* is a spacing for permitting mounting of the connector 700 to the heater 600 disposed in the belt 603. In this embodiment, as the middle region, the spacing of 26 mm was provided.

[Connector]

The connector 700 used with the fixing device 40 will be described in detail. FIG. 6 illustrates the connector 700. The connector 700 of this embodiment is electrically connected with the heater 600 by mounting to the heater 600. The connector 700 comprises a contact terminal 710 electrically connectable with the electrical contact 641, and a contact terminal 730 electrically connectable with the electrical contact 651. The connector 700 also comprises a contact terminal 720*a* electrically connectable with the electrical contact 661*a*, and a contact terminal 720*b* electrically connectable with the electrical contact 661*b*. The connector 700 sandwiches a region of the heater 600 extending out of the belt 603 so as not to contact the belt 603, by which the contact terminals are electrically connected with the electrical contacts, respectively. In the fixing device 40 having such a constitution in this embodiment, soldering or the like is not used for the connection between the connector and the electrical contacts. For this reason, the connection between the connector 700 and the heater 600 increasing in temperature with execution of the fixing process can be maintained with high reliability. Further, in the fixing device 40 in this embodiment, the connector 700 is detachably mountable to the heater 600, and therefore it is possible to easily exchange (replace) the belt 603 or the heater 600. In the following, a structure of the connector 700 will be described specifically using the drawing.

As shown in FIG. 6, the connector 700 including metal-made contact terminals 710, 720*a*, 720*b*, 730 is mounted to the heater 600 from the widthwise direction of the substrate 610 in the one end side 610*a* of the substrate 610. The respective contact terminals 710, 720*a*, 720*b*, 730 will be described using the contact terminal 710 as an example. As shown in FIG. 6, the contact terminal 710 is a member for electrically connecting the electrical contact 641 and a switch SW643 described later. The contact terminal 710 includes an electrical contact (unshown) to be contacted to the electrical contact 641 and a cable 712 to be connected with the switch SW643. The contact terminal 710 has a U-shape and is moved in an arrow direction in FIG. 6, so that the heater 600 can be inserted into a spacing of the U-shape of the contact terminal 710. At a position where the contact terminal 710 contacts the electrical contact 641, the electrical contact of the contact terminal 710 is provided, and by the contact of the electrical contact of the contact terminal 710 with the electrical contact 641, the electrical contact 641 and the contact terminal 710 are electrically connected with each other. The electrical contact of the contact terminal 710 has a spring property, and therefore contacts the electrical contact 641 while urging the electrical contact 641. For this reason, the contact terminal 710 sandwiches the heater 600 at front and back surfaces of the heater 600, so that the contact terminal 710 can fix a position thereof.

Similarly, the contact terminal 720*a* is a member for electrically connecting the electrical contact 661*a* and a switch SW663 described later. The contact terminal 720*a* includes a portion contacting the electrical contact 661*a* and a cable 722*a* to be connected with the switch SW663. Similarly, the contact terminal 720*b* is a member for electrically connecting the electrical contact 661*b* and a switch SW663 described later. The contact terminal 720*b* includes a portion contacting the electrical contact 661*a* and a cable 722*b* to be connected with the switch SW663. Similarly, the contact terminal 730 is a member for electrically connecting the electrical contact 651 and a switch SW653 described later. The contact terminal 730 includes a portion contacting the electrical contact 651 and a cable 732 to be connected with the switch SW653.

As shown in FIG. 6, the metal-made contact terminals 710, 720*a*, 720*b*, 730 are integrally held by a resin-made housing 750. The contact terminals 710, 720*a*, 720*b*, 730 are arranged in the housing 750 with spacings so as to be connectable with the electrical contacts 641, 661*a*, 661*b*, 651, respectively. Between adjacent two contact terminals 710, 720*a*, 720*b*, 730, a partition wall is provided, so that an electrically insulating property between the contact terminals is maintained.

In the above description, the example in which the connector 700 is mounted from the widthwise end portion of the substrate 610 was explained, but a manner of mounting the connector 700 to the substrate 610 is not limited thereto. For example, a constitution in which the connector 700 is mounted from the longitudinal end portion of the substrate 610 may also be employed.

[Electric Energy Supply to Heater]

An electric energy supply (energization) method to the heater 600 will be described. The fixing device 40 of this embodiment is capable of changing a width of the heat generating region of the heater 600 by controlling the electric energy supply to the heater 600 in accordance with the width size of the sheet P. With such a structure, the heat can be efficiently supplied to the sheet P. In the fixing device 40 of this embodiment, the sheet P is fed with the center of the sheet P aligned with the center of the fixing device 40, and therefore, the heat generating region extend from the center portion. The electric energy supply to the heater 600 will be described in conjunction with the accompanying drawings.

The power (voltage) source circuit 110 is a circuit for supplying the electric power to the heater 600. In this embodiment, the commercial voltage source (AC voltage source) of 100V in effective value (single phase AC) is used. The power source circuit 110 of this embodiment is provided with a power (voltage) source contact 110*a* and a power (voltage) source contact 110*b* having different electric potential. The power source circuit 110 may be DC voltage source if it has a function of supplying the electric power to the heater 600.

As shown in FIG. 4, the control circuit 100 is electrically connected with switch SW643, switch SW653, and switch SW663, respectively to control the switch SW643, switch SW653, and switch SW663, respectively.

Switch SW643 is a switch (relay) provided between the voltage source contact 110*a* and the electrical contact 641. The switch SW643 connects or disconnects between the voltage source contact 110*a* and the electrical contact 641 in accordance with the instructions from the control circuit 100. The switch SW653 is a switch provided between the voltage source contact 110*b* and the electrical contact 651. The switch SW653 connects or disconnects between the voltage source contact 110*b* and the electrical contact 651 in accordance with the instructions from the control circuit 100. The switch SW663 is a switch provided between the voltage source contact 110*b* and the electrical contact 661 (661*a*, 661*b*). The switch SW663 connects or disconnects between the voltage source contact 110*b* and the electrical contact 661 (661*a*, 661*b*) in accordance with the instructions from the control circuit 100.

When the control circuit 100 receives the execution instructions of a job, the control circuit 100 acquires the width size information of the sheet P to be subjected to the fixing process. In accordance with the width size information of the sheet P, a combination of ON/OFF of the switch SW643, switch SW653, switch SW663 is controlled so that the heat generation width of the heat generating element 620 fits the sheet P. At this time, the control circuit 100, the power source circuit 110, switch SW643, switch SW653, switch SW663 and the connector 700 functions as an electric power (energy) supplying means for the electric power to the heater 600.

When the sheet P is a large size sheet (a usable maximum width size), that is, when A3 size sheet is fed in the longitudinal direction or when the A4 size is fed in the landscape fashion, the width of the sheet P is 297 mm. Therefore, the control circuit 100 controls the electric power supply to provide the heat generation width B (FIG. 4) of the heat generating element 620. To effect this, the control circuit 100 renders ON all of the switch SW643, switch SW653, switch SW663. As a result, the heater 600 is supplied with the electric power through the electrical contacts 641, 661*a*, 661*b*, 651, so that all of the 12 sub-sections of the heat generating element 620 generate heat. At this time, the heater 600 generates the heat uniformly over the 320 mm region to meet the 297 mm sheet P.

When the size of the sheet P is a small size (narrower than the usable maximum width size), that is, when an A4 size sheet is fed longitudinally, or when an A5 size sheet is fed in the landscape fashion, the width of the sheet P is 210 mm. Therefore, the control circuit 100 provides a heat generation width A (FIG. 4) of the heat generating element 620. Therefore, the control circuit 100 renders ON the switch SW643, switch SW653 and renders OFF the switch SW663. As a result, the heater 600 is supplied with the electric power through the electrical contacts 641, 651, so that only 8 sub-sections of the 12 heat generating element 620 generate heat. At this time, the heater 600 generates the heat uniformly over the 213 mm region to meet the 210 mm sheet P.

As described above, in the fixing device 40 in this embodiment, the single connector 700 is mounted to the heater 600 in the one end side of the heater 600 with respect to the longitudinal direction, so that the electric power (energy) is supplied to the heater 600. For this reason, compared with the case where the connector is mounted to the substrate 610 at each of the both sides of the substrate 610, it is possible to suppress enlargement of the substrate 610 with respect to the longitudinal direction. The heater 600 is held by the holder 601 so that the one end side 610*d* of the substrate 610 with respect to the widthwise direction (short direction) is the upstream side with respect to the feeding direction of the sheet P, and the other end side 610*e* of the substrate 610 with respect to the widthwise direction is the downstream side with respect to the feeding direction of the sheet P. Accordingly, the heater 600 heats the upstream side of the nip N where heat is liable to be taken by the sheet P. For that reason, the heater 600 can properly heat the nip N in a broad range with respect to the feeding direction. Further, in this embodiment, heat can be efficiently conducted from the heat generating elements 620 to a low-temperature portion of the belt 603, and therefore unnecessary heat accumulation on the substrate 610 is suppressed. Accordingly, in this embodiment, in the heater 600, partial overheating due to the heat accumulation is suppressed.

Comparison Example

Figure 7:
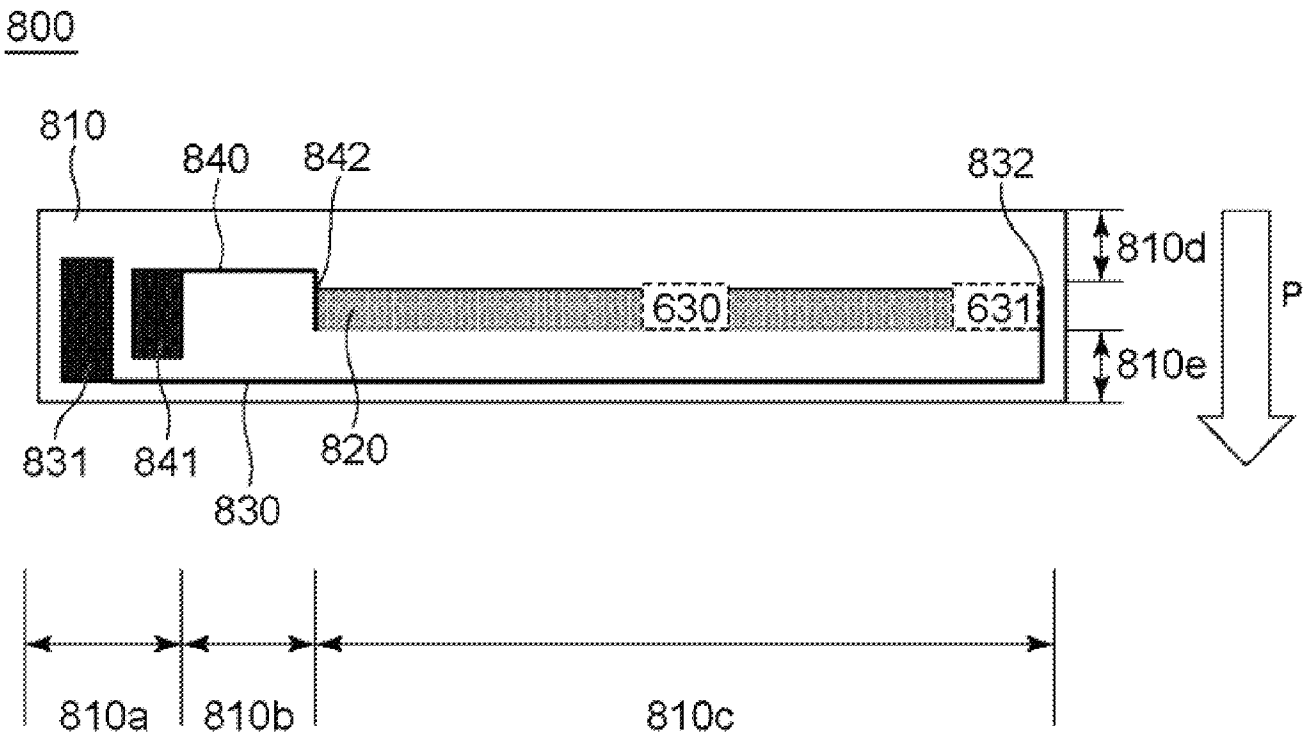
FIG. 7 is a schematic view showing a structure of a heater in a Comparison Example.

For comparison with this embodiment, a heater 800 having a conventional structure will be described as a Comparison Example. FIG. 7 is a schematic view showing the structure of the heater 800 in the Comparison Example. The heater 800 includes, as shown in FIG. 7, a substrate 810, a heat generating element 820 on the substrate 810, electroconductor patterns (840, 841, 842, 830, 831, 832) connected with the heat generating element 820, and an insulating coating layer (not shown) for covering these members. Materials, dimensions and manufacturing methods for the substrate 810 and the heat generating element 820 are the same as those in this embodiment.

As shown in FIG. 7, in one end side 810*a* of the substrate 810 with respect to the longitudinal direction, electrical contacts 831, 841 as a part of the electroconductor patterns are provided. In the other end side 810*c* of the substrate 810 with respect to the longitudinal direction, the heat generating element 820 and electrodes 832, 842 as a part of the electroconductor patterns are provided. A middle region 810*b* is provided between the one end side 810*a* and the other end side 810*c* of the substrate 810. In the middle region 810*b*, the electroconductive line 840 as a part of the electroconductor patterns is provided. In the other end side 810*e* of the substrate 810 relative to the heat generating element 820 with respect to the widthwise direction, the electroconductive line 830 as a part of the electroconductor patterns is provided.

The heat generating element 820 is 2 mm in width and 10 mm in thickness similarly as in this embodiment (Embodiment 1). The total length of the heat generating element 820 with respect to the longitudinal direction is the same as that in this embodiment, i.e., 320 mm which is the length in which the A4-sized sheet P (297 mm in width).

A resistance value of the heat generating element 820 is set uniformly over the longitudinal direction, and is adjusted so that a total heat generation amount in the entire region with respect to the longitudinal direction. Specifically, the resistance value of the heat generating element 820 is 7.7Ω.

The heat generating element 820 is provided at a central position of the substrate 810 with respect to the widthwise direction. That is, with respect to the widthwise direction of the substrate 810, widths of one end side 810*d* and the other end side 810*e* which are separated by the heat generating element 820 are the same. Specifically, the width of the substrate 810 is 9 mm and the width of the heat generating element 820 is 2 mm. The widths of the one end side 810*d* and the other end side 810*e* with respect to the widthwise direction (short direction) are 3.0 mm. The heater 800 having such a constitution is used in the fixing device 40 in which the sheet P is fed in an arrow direction in FIG. 7. That is, the heater 800 is disposed so that the one end side 810*d* is the upstream side and the other end side 810*e* is the downstream side. Incidentally, similarly as in Embodiment 1, the main thermistor 630 is provided at a central position of the heat generating element 820 with respect to the longitudinal direction and at a central position of the substrate 810 with respect to the widthwise direction. Further, similarly as in Embodiment 1, the sub-thermistor 631 is provided at one end portion of the heat generating element 820 with respect to the longitudinal direction and at a central position of the substrate 810 with respect to the widthwise direction.

Embodiment 2

Figure 8:
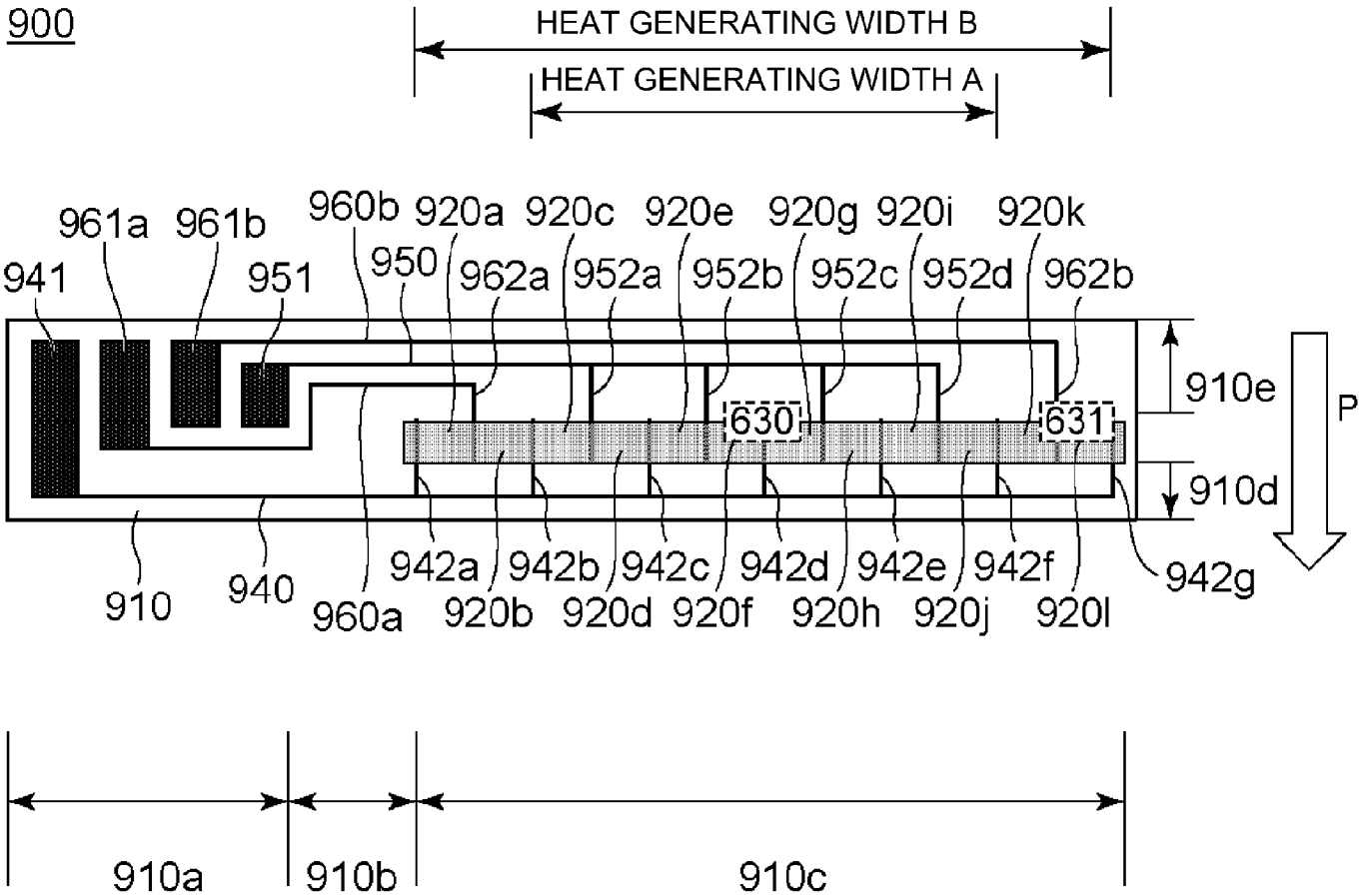
FIG. 8 is a schematic view showing a structure of a heater.

Embodiment 2 will be described. FIG. 8 illustrates a structure of a heater 900. Constitutions other than the structure of the heater 900 are similar to those in Embodiment 1, and therefore will be omitted from the detailed description. In the following, the structure of the heater 900 will be principally described. The heater 900 includes a heat generating element 920 which extends in a longitudinal direction of a substrate 910 and which is divided into 12 heat generating elements 920*a*-9201 by 7 electrodes 942*a*-942*g* and 6 electrodes 952, 962 (952*a*-952*d*, 962*a*, 962*b*). A difference from Embodiment 1 is that one end side 910*d* of the substrate 910 on which an electroconductive line 940 corresponding to the electroconductive line 640 in Embodiment 1 is provided in a downstream side with respect to the feeding direction of the sheet P. Embodiment 2 will be specifically described as follows.

As shown in FIG. 8, there are provided electrical contacts 941, 951, 961*a*, 961*b* as a part of the electroconductor pattern in one end side 910*a* of the substrate 910 with respect to the longitudinal direction. In addition, there are provided the heat generating element 920, the electrodes 942*a*-942*g* and the electrodes 952*a*-952*e*, 962*a*, 962*b* as a part of the electroconductor pattern in the other end side 910*c* of the substrate 910 with respect to the longitudinal direction of the substrate 910. Between the one end side 910*a* of the substrate 910 and the other end side 910*c*, a middle region 610*b* is provided.

Further, as shown in FIG. 8, in one end portion side 910*d* of substrate 910 beyond the heat generating element 920 with respect to the widthwise direction, the electroconductive line 940 consisting of a single line as a part of the electroconductor pattern is provided. In the other end side 910*e* of the substrate 910 beyond the heat generating element 920 with respect to the widthwise direction, the electroconductive lines 950 and 960 consisting of a plurality of lines are provided as a part of the electroconductor pattern. In the case where the above-described structure is intended to be disposed in a limited space on the substrate 910, the heat generating element 920 is disposed so as to be offset from a center line of the substrate 910 with respect to the widthwise direction of the substrate 910. This is because the electroconductive line 940 is the single line and on the other hand, electroconductive lines 950, 960 (960*a*, 960*b*) are the plurality of lines and require a broad disposing space. Specifically, with respect to a length (width) of 9 mm of the substrate 910 with respect to the widthwise direction of the substrate 910, the width (widthwise length) of the heat generating element 920 was 2 mm, the width of the substrate 910 in the one end side 910*a* was 2 mm, and the width of the substrate 910 in the other end side 910*e* was 5 mm. That is, the heat generating element 920 is offset from the center line toward the electroconductive line 940 side by 1.5 mm with respect to the widthwise direction of the substrate 910.

The heater 900 having such a constitution is used in the fixing device 40 in which the feeding direction of the sheet P is an arrow direction in FIG. 8. That is, the heater 900 is disposed so that the one end side 910*d* is the upstream side and the other end side 910*e* is the downstream side with respect to the feeding direction of the sheet P.

Incidentally, similarly as in Embodiment 1, the main thermistor 630 is provided at a central position of the heat generating element 920 with respect to the longitudinal direction and at a central position of the substrate 910 with respect to the widthwise direction. Further, similarly as in Embodiment 1, a sub-thermistor 631 is provided at one end portion of the heat generating element 920 with respect to the longitudinal direction and at a central position of the substrate 910 with respect to the widthwise direction.

[Evaluation]

In order to verify effects of Embodiments 1 and 2, each of the heaters in Embodiments 1 and 2 and Comparison Example was mounted in the fixing device 40 and then an evaluation test was conducted. The evaluation test was conducted in an environment of a low temperature (about 15° C.) and a low humidity (about 10% RH) by continuously subjecting sheets P to the fixing process in the fixing device 40 and by counting a print number until a throughput decreased. The print number was 500 sheets at the maximum. In the evaluation test, the sheet P was A4-sized paper (Trade name "CS-814", available from Canon K.K.) (210 mm in width) and was fed through short edge feeding.

In the evaluation test, the control circuit 100 of the fixing device 40 adjusts a heat generation amount of the heater 600 so that a detected temperature of the main thermistor 630 is maintained at 200° C. In the case where the detected temperature of the sub-thermistor 631 is less than 270° C., the control circuit 100 effects continuous printing with a throughput of 40 sheets/min. In the case where the detected temperature of the sub-thermistors 631 are not less than 270° C., the control circuit 100 effects the continuous printing with a throughput of 20 sheets/min. That is, in the case where the detected temperature of the sub-thermistors $\mathbf{631}_7$ is changed from less than 270° C. to not less than 270° C., the state of the fixing device 40 changes to a throughput down state.

Incidentally, in the evaluation test for Embodiments 1 and 2, the heat generating elements 620, 920 are heated with the heat generating width A (FIGS. 4 and 8). In the case where the heater 600 is used, the fixing device 40 causes only 8 sections (the heat generating elements 620*c*-620*j*, 220 mm in width) of 12 sections of the heat generating element 620 to generate heat by the energization from the electrical contacts 641, 651. In the case where the heater 900 is used, the fixing device 40 causes only 8 sections (the heat generating elements 920*c*-920*j*, 220 mm in width) of 12 sections of the heat generating element 920 to generate heat by the energization from the electrical contacts 941, 951.

A result of the evaluation test conducted under the above-described condition is shown in Table 1.

TABLE 1

| | HEATER | OFFSET*1 | TP DOWN*2 |
|---|---|---|---|
| EMB. 1 | 600 | 1.5 mm (US) | NO TP DOWN |
| COMP. EX. | 800 | 0 mm | 18 sheets |
| EMB. 2 | 900 | 1.5 mm (DS) | 364 sheets |

*1"OFFSET" is an amount (distance) of offset of a widthwise center line of the heat generating element from a widthwise center line of the substrate.
*2"TP DOWN" represents a print number at which throughput down starts in the fixing process of 500 sheets of the A4-sized paper fed through the short edge feeding. "NO TP DOWN" represents no throughput down occurred.

According to Table 1, with respect to the heater 800 in the Comparison Example, it is understood that the throughput down early occurred in a stage of the 18-th sheet as the print number of the sheets subjected to the fixing process. This is attributable to the constitution of the heater 800 in the Comparison Example in which the entire longitudinal region of the heat generating element 820 is caused to generate heat. When the heat generating element 820 generates heat in the entire longitudinal region, the belt 603 is heated with a width of 320 mm with respect to the widthwise direction of the belt 603, but the width (length) of a region where the heat of the belt 603 is taken by the sheet P is 213 mm with respect to the widthwise direction of the belt 603. For that reason, with respect to the widthwise direction of the belt 603, a region of 107 mm is excessively heated and accumulates the heat. Heat conduction from the heater 800 to the heat accumulation region of the belt 603 is difficult, and therefore also the heater 800 accumulates the heat similarly as in the case of the belt 603. The heat accumulation of the heater 800 is detected by the sub-thermistor 631, so that the fixing device 40 is in a throughput down state.

On the other hand, in the heater 600 in Embodiment 1, only the heat generating width A (220 mm in width) can be caused to generate heat, and therefore the width of the excessively heated region is 7 mm with respect to the widthwise direction of the belt 603. For that reason, it is possible to suppress the heat accumulation in the heater 600. As a result, in Embodiment 1, as shown in Table 1, even when the fixing process of 500 sheets was performed, the fixing device 40 was not in the throughput down state.

In the heater 900 in Embodiment 2 capable of heating only the heat generating width (220 mm in width) similarly as in Embodiment 1, although the result is different from the result of Embodiment 1, the fixing device 40 is not in the throughput down state until the print number reaches 364 sheets, and thus is at a practically acceptable level. The different from Embodiment 1 is attributable to a difference in constitution between Embodiments 1 and 2, i.e., in the heater 600 in Embodiment 1, the heat generating element 620 is disposed so as to be offset toward the upstream side with respect to the feeding direction of the sheet P, whereas in the heater 900 in Embodiment 2, the heat generating element 920 is disposed so as to be offset toward the downstream side with respect to the feeding direction of the sheet P.

As described above, the sheet P is subjected to the fixing process by passing through the nip N from the upstream side to the downstream side.

In this case, the sheet P fed to the nip N in a normal temperature state absorbs heat in the upstream side of the nip N and the temperature of the sheet P reaches a fixing temperature, and then the sheet P passes through the downstream side of the nip N in a state in which the fixing temperature is maintained. In other words, in the nip N, a large amount of heat is applied to the sheet P in the upstream side, and a small amount of heat is applied to the sheet P in the downstream side.

In the heater 600 in Embodiment 1, the heat generating element 620 is disposed so as to be shifted toward the upstream side with respect to the feeding direction of the sheet P, and therefore the heat taken by entering of the sheet P into the nip N at the upstream side can be quickly replenished. Accordingly, even in the case where the throughput of the fixing process is high, the temperature of the sheet P can be instantaneously increased up to the fixing temperature in the upstream side of the nip N, and the state is maintained also in the downstream side of the nip N, so that an image T can be fixed on the sheet P with reliability. That is, the heater 600 in Embodiment 1 can heat the sheet P in a long region of the nip N with respect to the feeding direction, and therefore the fixing process can be stably performed. At this time, the detected temperature of the main thermistor 630 is stable, and therefore unnecessary electric power supply to the heater 600 is suppressed. For that reason, the heater 600 can suppress heat generation and heat accumulation of the longitudinal end portion. Thus, the heater 600 was able to obtain a good result in the evaluation test.

On the other hand, in the heater 900 in Embodiment 2, the heat generating element 920 is disposed so as to be shifted toward the downstream side with respect to the feeding direction of the sheet P, and therefore it is difficult to quickly replenish the heat taken by entering of the sheet P into the nip N at the upstream side. Accordingly, in the case where the throughput of the fixing process is high, it is difficult to increase the temperature of the sheet P to the fixing temperature until the sheet P is fed to in the downstream side of the nip N. That is, the heater 900 in Embodiment 2 heats the sheet P in a short region of the nip N with respect to the feeding direction, and therefore the fixing process can become unstable. At this time, the detected temperature of the main thermistor 630 is unstable, and therefore electric power is excessively supplied to the heater 900. For that reason, the heater 900 unnecessarily generates and accumulates the heat at the longitudinal end portion. For that reason, the structure of the heater 900 is preferable.

OTHER EMBODIMENTS

The embodiments to which the present invention is applicable were described above, but numerical values such as dimensions mentioned in the embodiments are examples and are not limited thereto. Within a scope to which the present invention is applicable, the numerical value can be appropriately selected. In addition, within the scope to which the present invention is applicable, the constitutions described in the embodiments may also be appropriately changed.

The pattern of the heat generating region of the heaters in Embodiments 1 and 2 is not limited to only two patterns consisting of a large size and a small size. For example, 3 or more patterns may also be used in the heat generating region. That is, the number of electrical contacts is not limited to 4, but 5 or more electrical contacts may also be provided. For example, in Embodiment 1, an electrical contact different from the electrical contacts 641, 651, 661*a*, 661*b* may also be provided.

The electrical contacts 641, 651, 661*a*, 661*b* are not necessarily required to be disposed collectively in one longitudinal end side of the substrate 610. For example, the electrical contacts 641, 661*a* may also be disposed in the one longitudinal end side of the substrate 610 and the electrical contacts 651, 661*b* may also be disposed in the other longitudinal end side of the substrate 610. However, from the viewpoint that enlargement of a longitudinal size of the substrate can be suppressed, the structure in Embodiments 1 and 2 is preferable.

The forming method of the heat generating element is not limited to those disclosed in Embodiment 1. In Embodiment 1, the electrode 642 and in the electrodes 652, 662 are laminated on the heat generating element 620 extending in the longitudinal direction of the substrate 610. However, the electrodes are formed in the form of an array extending in the longitudinal direction of the substrate 610, and the heat generating elements 620*a*-620*l* may be formed between the adjacent electrodes.

The belt is not limited to that supported by the heater at the inner surface thereof and driven by the roller. For example, a so-called belt unit type in which the belt is extended around a plurality of rollers and is driven by one of the rollers. However, the structures of Embodiments 1 and 2 are preferable from the standpoint of low thermal capacity.

The rotatable member cooperative with the belt to form the nip is not limited to the roller member. For example, a belt extended around a plurality of rollers may also be used.

The image forming apparatus which was described using the printer as an example is not limited to that capable of forming a full-color, but it may be a monochromatic image forming apparatus. The image forming apparatus may be a copying machine, a facsimile machine, a multifunction machine having the function of them, or the like, for example, which are prepared by adding necessary device, equipment and casing structure.

The image heating apparatus is not limited to the fixing device for fixing a toner image on a sheet P, described as an example in the above embodiments. It may be a device for fixing a partly-fixed toner image on the sheet, or a device for heating an already fixed image. That is, the image heating apparatus may be a surface heating apparatus for adjusting a glossiness and/or surface property of the image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2015-004729 filed on Jan. 14, 2015 and 2015-219840 filed Nov. 9, 2015, which are hereby incorporated by reference herein in their entirety.

What is claimed is:

1. A heater usable with an image heating apparatus including an electric energy supplying portion provided with a first terminal and a second terminal, and an endless belt configured to heat an image on a sheet, wherein said heater is contactable to the belt to heat the belt, said heater comprising:

a substrate;

a first electrical contact provided on said substrate and electrically connectable with the first terminal;

a plurality of second electrical contacts provided on said substrate and electrically connectable with the second terminal;

a plurality of electrode portions including first electrode portions electrically connected with said first electrical contact and second electrode portions electrically connected with said second electrical contacts, said first electrode portions and said second electrode portions being arranged alternately with predetermined gaps in a longitudinal direction of said substrate;

a plurality of heat generating portions provided between adjacent ones of said electrode portions so as to electrically connect between adjacent electrode portions, said heat generating portions being capable of generating heat by electric power supply between adjacent electrode portions;

a first electroconductive line portion configured to electrically connect said first electrical contact and said first electrode portions; and a second electroconductive line portion configured to electrically connect one of said second electrical contacts and a part of said second electrode portions;

wherein said heat generating portions are disposed so as to be offset from a center line of said substrate with respect to a widthwise direction of said substrate.

2. A heater according to claim 1, wherein said heat generating portions are disposed so as to be offset from the center line toward an upstream with respect to a sheet feeding direction.

3. A heater according to claim 2, further comprising a third electroconductive line portion configured to electrically connect a second electrical contact different from said one of second electrical contacts and a predetermined second electrode portion different from the part of said second electrode portions.

4. An image heating apparatus comprising:

an electric energy supplying portion provided with a first terminal and a second terminal;

a belt configured to heat an image on a sheet;

a substrate provided inside said belt and extending in a widthwise direction of said belt;

a first electrical contact provided on said substrate and electrically connectable with the first terminal;

a plurality of second electrical contacts provided on said substrate and electrically connectable with the second terminal;

a plurality of electrode portions including first electrode portions electrically connected with said first electrical contact and second electrode portions electrically connected with said second electrical contacts, said first electrode portions and said second electrode portions being arranged alternately with predetermined gaps in a longitudinal direction of said substrate;

a plurality of heat generating portions provided between adjacent ones of said electrode portions so as to electrically connect between adjacent electrode portions, said heat generating portions being capable of generating heat by electric power supply between adjacent electrode portions;

a first electroconductive line portion configured to electrically connect said first electrical contact and said first electrode portions; and a second electroconductive line portion configured to electrically connect one of said second electrical contacts and a part of said second electrode portions; and a third electroconductive line portion configured to electrically connect a second electrical contact different from said one of said second electrical contacts and a predetermined second electrode portion different from the part of said second electrode portions, wherein said electric energy supplying portion supplies electric power through said first electroconductive line portion and said second electroconductive line portion to heat generating portions, of said plurality of heat generating portions, in a first heat generating region along the longitudinal direction when a sheet having a predetermined width size narrower than a maximum width size of a sheet capable of being introduced into said image heating apparatus is heated, and supplies electric power through said first electroconductive line portion, said second electroconductive line portion and said third electroconductive line portion to heat generating portions, of said plurality of heat generating portions, which are disposed in the first heat generating region and which are disposed in a second heat generating region adjacent to the first heat generating region in the longitudinal direction when a sheet having a width size broader than the predetermined width size is heated, and wherein said heat generating portions are disposed so as to be offset from a center line of said substrate with respect to a widthwise direction of said substrate.

5. An image heating apparatus according to claim 4, wherein said heat generating portions are disposed so as to be offset from the center line toward an upstream with respect to a sheet feeding direction.

* * * * *